US012767304B2

(12) United States Patent
Coller

(10) Patent No.: US 12,767,304 B2
(45) Date of Patent: Oct. 20, 2026

(54) MARINE PROPULSION SYSTEM WITH A CLOSED COOLANT LOOP

(71) Applicant: Freedom Outboard, LLC, Victor, NY (US)

(72) Inventor: Thomas Charles Coller, Honeoye Falls, NY (US)

(73) Assignee: Freedom Outboard, LLC, Victor, NY (US)

( * ) Notice: Subject to any disclaimer, the term of this patent is extended or adjusted under 35 U.S.C. 154(b) by 325 days.

(21) Appl. No.: 18/440,879

(22) Filed: Feb. 13, 2024

(65) Prior Publication Data

US 2025/0256825 A1 Aug. 14, 2025

(51) Int. Cl.
*B63H 20/28* (2006.01)
*F01P 3/20* (2006.01)

(52) U.S. Cl.
CPC ..... *B63H 20/28* (2013.01); *F01P 3/202* (2013.01)

(58) Field of Classification Search
CPC ..... B63H 20/28; B63H 20/001; B63H 20/32; B63H 20/34; F01P 3/202
See application file for complete search history.

(56) References Cited

U.S. PATENT DOCUMENTS 4,509,924 A * 4/1985 Hall ..... B63H 20/34 440/51
5,383,803 A * 1/1995 Pilgrim ..... F01P 3/202 440/88 HE
5,531,010 A * 7/1996 Icenogle ..... B29C 70/683 29/401.1
7,128,025 B1 * 10/2006 Westhoff, Jr. ..... F01P 7/165 123/41.01
7,485,020 B2 * 2/2009 Nakamura ..... B63H 20/14 440/78
8,216,011 B2 * 7/2012 Ogasawara ..... B63H 20/34 114/271
9,545,985 B1 * 1/2017 Provost ..... B63H 20/002
9,580,159 B1 * 2/2017 Provost ..... B63H 20/28
9,815,539 B1 * 11/2017 Provost ..... B63H 20/285
9,845,139 B1 * 12/2017 Provost ..... B63H 20/002
9,914,516 B1 * 3/2018 MacDonald ..... B63H 5/165
10,358,202 B2 * 7/2019 Gil ..... B63H 20/14
10,364,010 B2 7/2019 Coller et al.
10,429,136 B2 10/2019 Coller et al.
10,533,484 B2 1/2020 Coller et al.
2023/0084989 A1 3/2023 Bruneau et al.
2023/0150636 A1 5/2023 Norton et al.
2023/0249795 A1 8/2023 Breyer
2024/0235329 A1 * 7/2024 Norton ..... H05K 7/20263

* cited by examiner

*Primary Examiner* — Magdalena Topolski
(74) *Attorney, Agent, or Firm* — Patent Technologies, LLC; Robert D. Gunderman

(57) ABSTRACT

A marine propulsion system with a closed coolant loop is described. The marine propulsion system has a starboard heat exchanger and a port side heat exchanger that provides improved cooling and increases engine life compared with traditional open loop cooling systems, particularly in harsh environments such as salt water, brackish water, swamp, shallow or sediment and debris rich water. The two discrete heat exchangers are mounted to the lower unit of the marine propulsion system and also serve to improve hydrodynamic performance of the marine propulsion system.

20 Claims, 36 Drawing Sheets

MARINE PROPULSION SYSTEM WITH A CLOSED COOLANT LOOP

CROSS REFERENCE TO RELATED PATENT APPLICATIONS

BACKGROUND OF THE INVENTION

1. Field of the Invention

The present invention relates generally to propulsion systems for marine vessels, and more particularly to an outboard marine propulsion system with a closed coolant loop having two discrete lower unit heat exchangers.

2. Description of the Related Art

Outboard motors that are manufactured today use an open loop cooling system where water is drawn from the marine operating environment into the outboard motor for cooling purposes. The water is passed through the engine, oil cooler, fuel cooling system, and exhaust and then returned to the marine operating environment. Such an open loop cooling system is both efficient and cost effective, but there are some drawbacks to an open loop cooling system that can result in not only performance issues, but early engine failure. Further, an open loop cooling system restricts operation to clear water conditions, as use in muddy or overgrown waterways would quickly clog the cooling passageways and result in damage to the motor.

An open loop cooling system can lead to the plugging of internal engine passages through debris such as mud, stones, weeds, leaves, and the like, all of which can be drawn in with the intake water used for cooling. In addition, when an outboard motor with such an open loop cooling system is operated in salt water, the untreated cast aluminum cooling channels inside the outboard motor will oxidize over time. Small water channels within the outboard motor will become plugged with aluminum oxide that breaks free from oxidized areas within the engine, plugging those cooling channels and causing the engine to run hot or overheat and eventually fail. While aluminum is less corrosive than steel and iron products, it will still oxidize and eventually fail over time. Plugged water channels may cause an engine to overheat with resulting damage. In some cases, the oxidation may be so severe that the internal walls of the motor become porous such that cooling water enters the combustion side of the engine, causing engine failure and the need for engine replacement, a costly proposition.

While outboard motor manufacturers use a plastic intake screen to prevent large solids from being drawn into the engine through the open loop cooling system, overheating will occur when the plastic screen is covered with debris such as weeds, leaves, mud, dirt and the like. Once the intake screen is covered with debris, water flow to the engine stops, leading to engine overheating and at a minimum the destruction of the water pump impeller within the engine.

In U.S. Pat. No. 10,429,136 B2 to Coller et al. and entitled Outboard Marine Propulsion System With Closed Loop Lower Unit Heat Exchanger, a single lower unit heat exchanger is disclosed comprising coils contained in a housing. In U.S. Pat. No. 10,533,484 B2 to Coller et al. and entitled Outboard Marine Propulsion System With Closed Loop Lower Unit Heat Exchanger, a downwardly curved lower unit heat exchanger joined as one heat exchanger is disclosed. To facilitate operation of an outboard marine propulsion system in a shallow and obstructed water environment, a Marine Propulsion Unit is disclosed in U.S. Pat. No. 10,364,010 B2 to Coller et al. The entire disclosure of each of these three United States Patents in incorporated herein by reference in their entirety.

What is needed is a marine propulsion system having a novel closed loop cooling system with two discrete lower unit heat exchangers. What is further needed is a marine propulsion system having such a novel closed loop cooling system with two discrete lower unit heat exchangers and a surface drive extension for operation in shallow and obstructed water.

It is thus an object of the present invention to provide such a marine propulsion system and also provide for a surface drive extension, as will be further described herein. These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a marine propulsion system with a closed coolant loop, the marine propulsion system comprising an outboard motor comprising a power head and a submerged drive unit; coolant passageways within the power head of the outboard motor; a starboard heat exchanger and a port side heat exchanger each having a leading edge and a trailing edge, wherein both the starboard heat exchanger and the port side heat exchanger are each discretely mounted on the submerged drive unit of the outboard motor and in closed fluid communication with the coolant passageways within the power head of the outboard motor; a coolant reservoir mechanically attached to the marine propulsion system; and a water pump configured to circulate coolant between the coolant reservoir, the starboard heat exchanger and the port side heat exchanger, and the coolant passageways within the power head of the outboard motor.

The foregoing paragraph has been provided by way of introduction, and is not intended to limit the scope of the invention as described by this specification, claims and the attached drawings.

BRIEF DESCRIPTION OF THE DRAWINGS

The invention will be described by reference to the following drawings, in which like numerals refer to like elements, and in which.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification, claims, and drawings attached hereto.

DESCRIPTION OF THE PREFERRED EMBODIMENTS

The marine propulsion system of the present invention will be described by way of example and not limitation. The marine propulsion system with closed coolant loop, as described and depicted herein, is configured as an outboard motor which has a power head and a submerged drive unit. In some embodiments of the present invention, the outboard motor is a four stroke motor. Attached to or otherwise connected with the submerged drive unit is a starboard heat exchanger and a port side heat exchanger, each having a leading edge and a trailing edge. Both the starboard heat exchanger and the port side heat exchanger are in closed fluid communication with coolant passageways within the power head of the outboard motor. There is further a coolant reservoir mechanically attached to the marine propulsion system for retention of surplus or buffer coolant where the coolant reservoir is in fluid communication with each heat exchanger and the coolant passageways within the power head of the outboard motor. There is further a water pump configured to circulate coolant between the coolant reservoir, the starboard heat exchanger and the port side heat exchanger, and the coolant passageways within the power head of the outboard motor.

In some embodiments of the present invention, a surface drive extension is provided. The surface drive extension has an elongated drive tunnel, a skeg having an upper section and a lower section where the upper section is joined with the elongated drive tunnel, a skeg foil attached to the lower section of the skeg, a mounting fin attached to the elongated drive tunnel, and a driveline within the elongated drive tunnel. The driveline has a drive shaft coupling configured to receive a drive shaft from a marine propulsion system and an extension shaft configured to receive a marine propeller.

The various constituent components of the present invention may be provided individually, as a complete unit or system, or in a kit or component form. The descriptions of each of these constituent components and their interaction and elements thereof being further described as follows.

Figure 1:
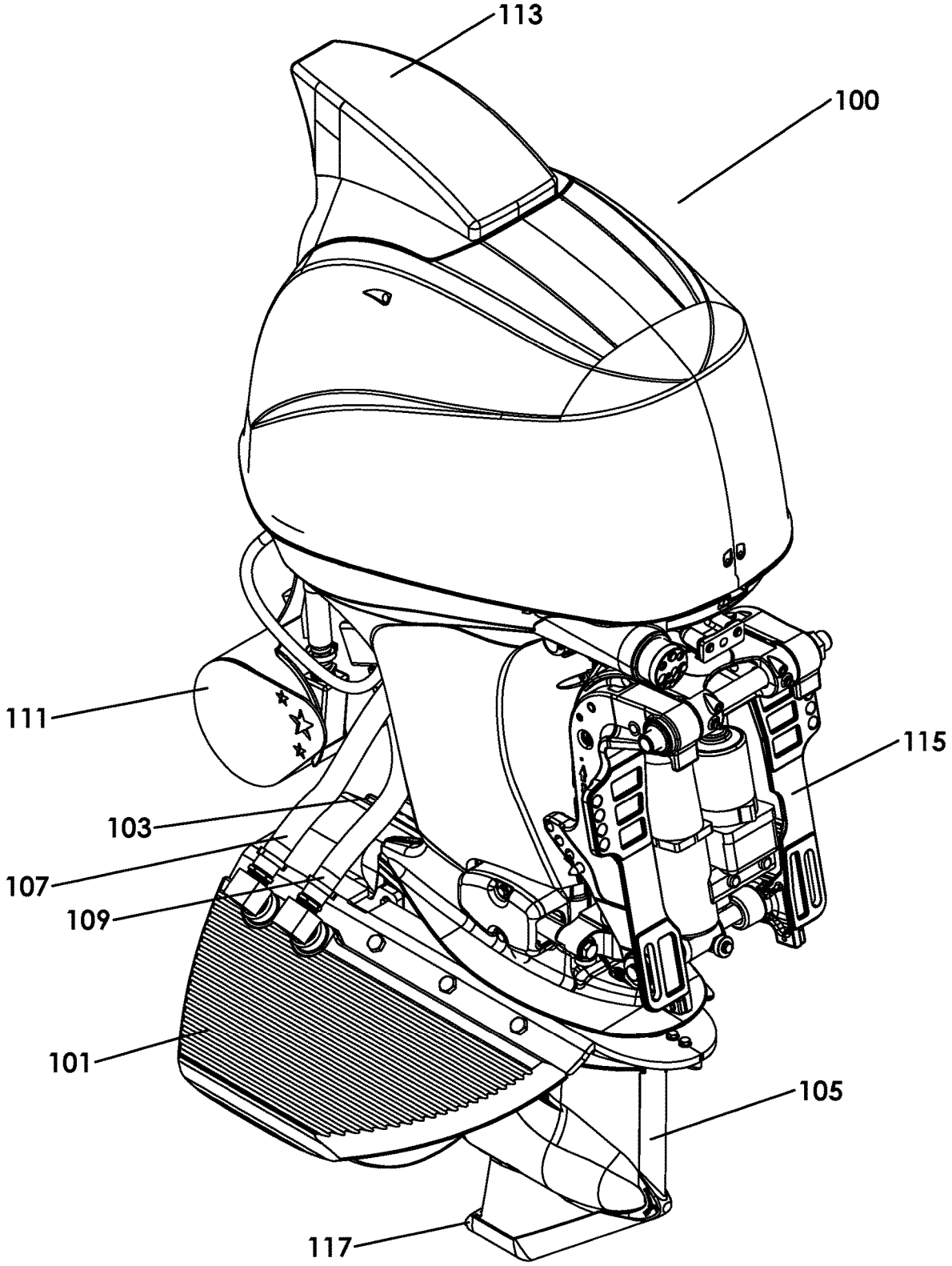
FIG. 1 is a perspective view of a marine propulsion system with a closed coolant loop in accordance with the present invention.

Turning now to FIG. 1, a perspective view of a marine propulsion system with a closed coolant loop 100 is depicted. The marine propulsion system of the present invention is configured as an outboard motor with a novel closed coolant loop arrangement. The marine propulsion system 100 has a power head and a submerged drive unit, as is customary with outboard motors. The submerged drive unit comprises the portion of the marine propulsion system that is submerged or partially submerged in the water during operation. The power head is not submerged, and comprises the motor and related elements. The submerged drive unit, however, has a novel cooling system that includes a starboard heat exchanger 101 and a port side heat exchanger 103. In operation, the starboard heat exchanger 101 and the port side heat exchanger 103 may be fully submerged or partially submerged. Each heat exchanger has two coolant lines connected thereto, serving as an input and an output respectively. Within each heat exchanger there is a plurality of internal passageways to accommodate the flow of coolant and associated heat transfer, where heat transfer is from the coolant, through the heat exchanger and into the operating environment (a body of water) while the coolant remains within the closed loop of the marine propulsion system 100. The internal passageways may, in one embodiment, be serpentine passageways. Each heat exchanger also have cooling ridges or other such structures formed on their exterior to increase the effective surface area and related heat transfer. The starboard heat exchanger 101 and the port side heat exchanger 103 are also symmetrical with each other, and may, in one embodiment, have a downward angle when installed on a marine propulsion system.

Figure 35:
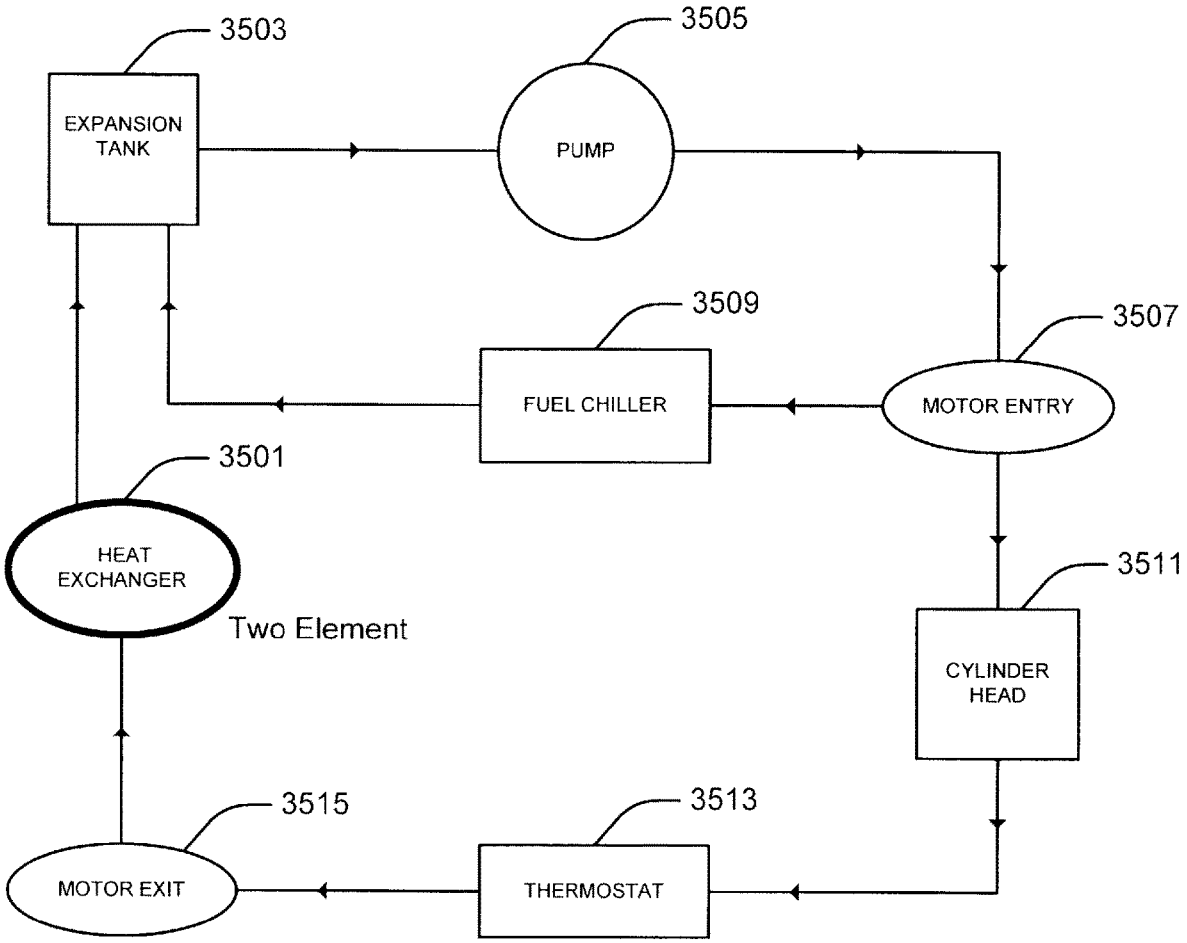
FIG. 35 is a functional block diagram of the cooling system of the present invention.

The closed loop coolant flow can be seen diagrammatically in FIG. 35, and will be further described herein. Each heat exchanger is made from a metal such as aluminum, brass, stainless steel, or the like. Manufacturing techniques include, but are not limited to, casting, machining, 3D printing, and the like. Depicted in FIG. 1 are a first coolant line 107 and a second coolant line 109. Each coolant line may be made from a flexible material such as EPDM (ethylene propylene diene monomer), Silicone, Nitrile, or the like. The coolant lines are terminated with a connector that is configured to mate with the heat exchanger using a threaded or otherwise suitable fitting.

Each heat exchanger is bolted or otherwise fastened to the submerged drive unit. A coolant reservoir 111 can be seen mounted to the midsection area of the outboard drive unit. The coolant reservoir is made from a metal such as stainless steel, copper, brass, aluminum, or a plastic such as polyethylene or the like. A water pump cover 113 can be seen atop the cover for the power head. The water pump cover 113 contains a water pump that may, in some embodiments, be a mechanical water pump that is driven from the camshaft of the outboard drive unit.

To facilitate attachment of the marine propulsion system to the transom of a boat, a clamp bracket 115 can be seen. The clamp bracket 115 may also have hydraulic or electric actuators to move the marine propulsion system vertically and also raise and lower the marine propulsion system in relation to the transom of a boat. The clamp bracket 115 may be made from a metal such as stainless steel, steel with a rust resistant coating, aluminum, titanium, or the like.

To protect the leading edge of the submerged drive unit of the marine propulsion system of the present invention, a bumper 105 can be seen. The bumper 105 is made from a durable metal such as stainless steel, steel with a rust resistant coating, aluminum, titanium, or the like, and is shaped to conform to the leading edge of the submerged drive unit of the marine propulsion system, and protects the leading edge of the submerged drive unit from underwater obstacles that may be encountered. A bumper keeper 117 can also be seen that secures and retains the bumper 105 to the submerged drive unit of the marine propulsion system.

Figure 2:
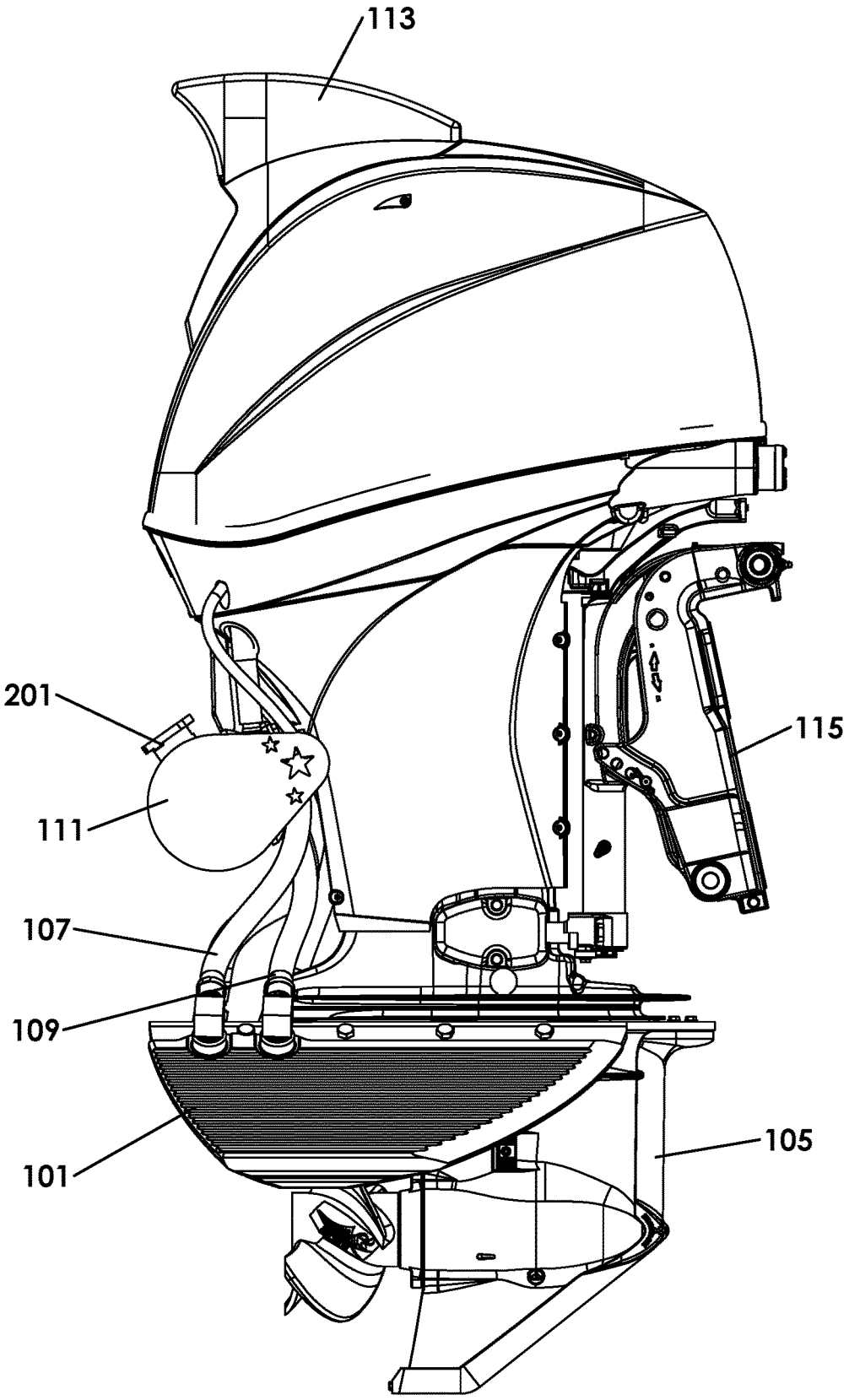
FIG. 2 is a side view of the marine propulsion system of FIG. 1.

FIG. 2 is a side view of the marine propulsion system of the present invention where the starboard heat exchanger 101 can be clearly seen along with the first coolant line 107 and the second coolant line 109. The coolant reservoir 111 can be seen with a coolant reservoir cap 201 that allows coolant to be observed or added to the coolant reservoir. The coolant reservoir cap 201 may have a locking mechanism to prevent the sudden release of hot coolant should the coolant reservoir 111 be in use and pressurized when the coolant reservoir cap 201 is removed.

In FIG. 2, the leading edge and the trailing edge of the starboard heat exchanger 101 can be seen. It should be noted that both the leading edge and the trailing edge of each heat exchanger, in one embodiment, are outwardly curved, as evident herein.

Figure 3:
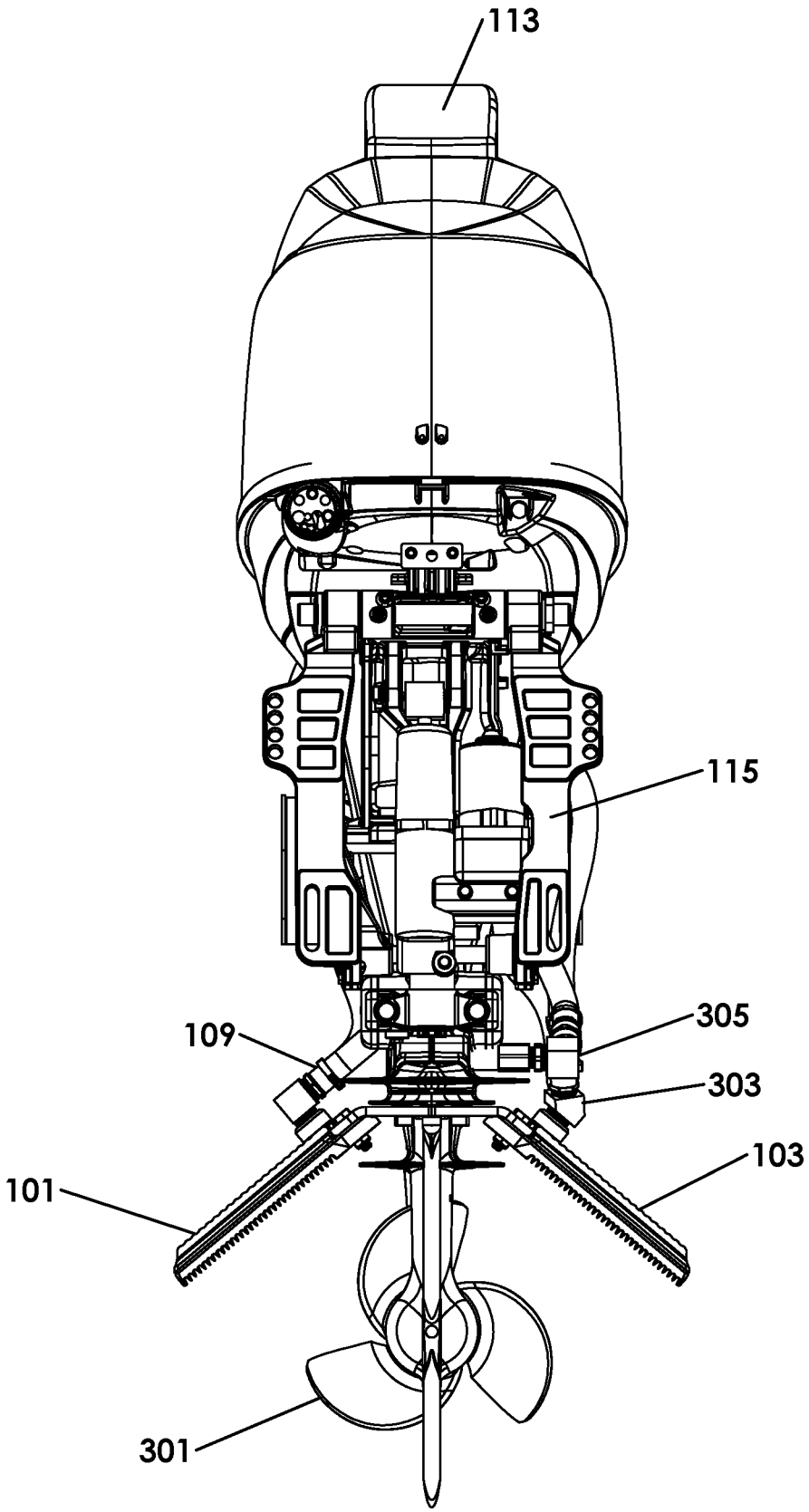
FIG. 3 is a front facing view of the marine propulsion system of FIG. 1.

FIG. 3 is a front facing view of the marine propulsion system of the present invention. In this view, a third coolant line 303 and a fourth coolant line 305 can be seen fluidically connected to the port side heat exchanger 103. Each coolant line may be made from a flexible material such as EPDM (ethylene propylene diene monomer), Silicone, Nitrile, or the like. The coolant lines are terminated with a connector that is configured to mate with the heat exchanger using a threaded or otherwise suitable fitting.

Also seen in FIG. 3 is a weedless propeller 301. While a variety of propellers may be used with the marine propulsion system of the present invention, a weedless propeller 301 that has a reinforced and robust structure along with truncated blade tips is ideally suited for operation in a harsh obstructed marine environment such as the environment where the marine propulsion system of the present invention may be desirable and beneficial. The weedless propeller may be made from stainless steel, aluminum, an aluminum alloy, brass, or any material suitable for marine propellers.

The downward pitch of the heat exchangers can also be seen in FIG. 3 where such a downward pitch serves to improve the hydrodynamic efficiency of the marine propulsion system of the present invention given the discrete nature of the two heat exchangers that terminate on the submerged drive unit of the marine propulsion system of the present invention.

Figure 4:
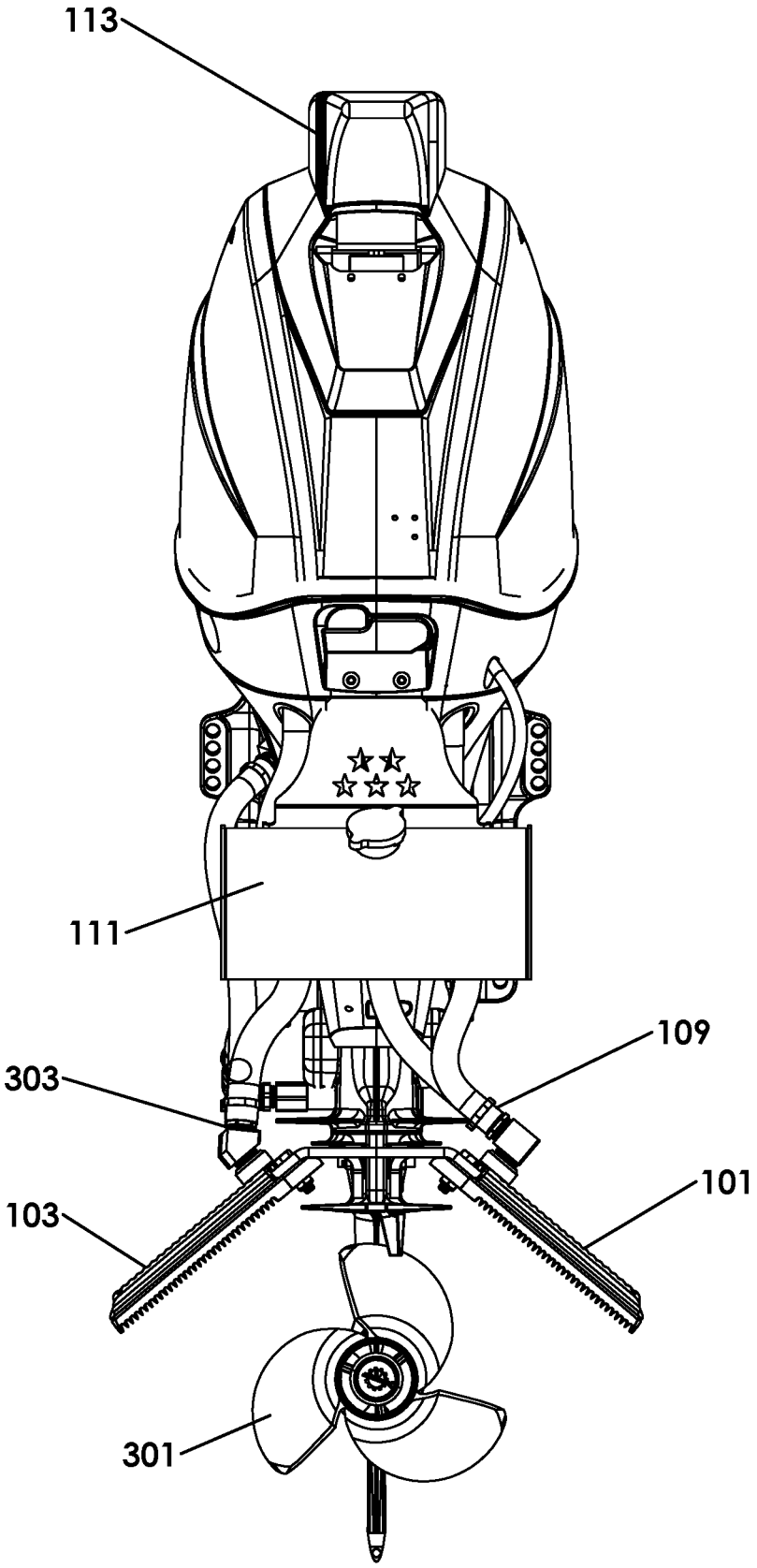
FIG. 4 is a rear facing view of the marine propulsion system of FIG. 1.

FIG. 4 is a rear facing view of the marine propulsion system of the present invention where the profile of the mounted heat exchangers can be clearly seen.

Figure 5:
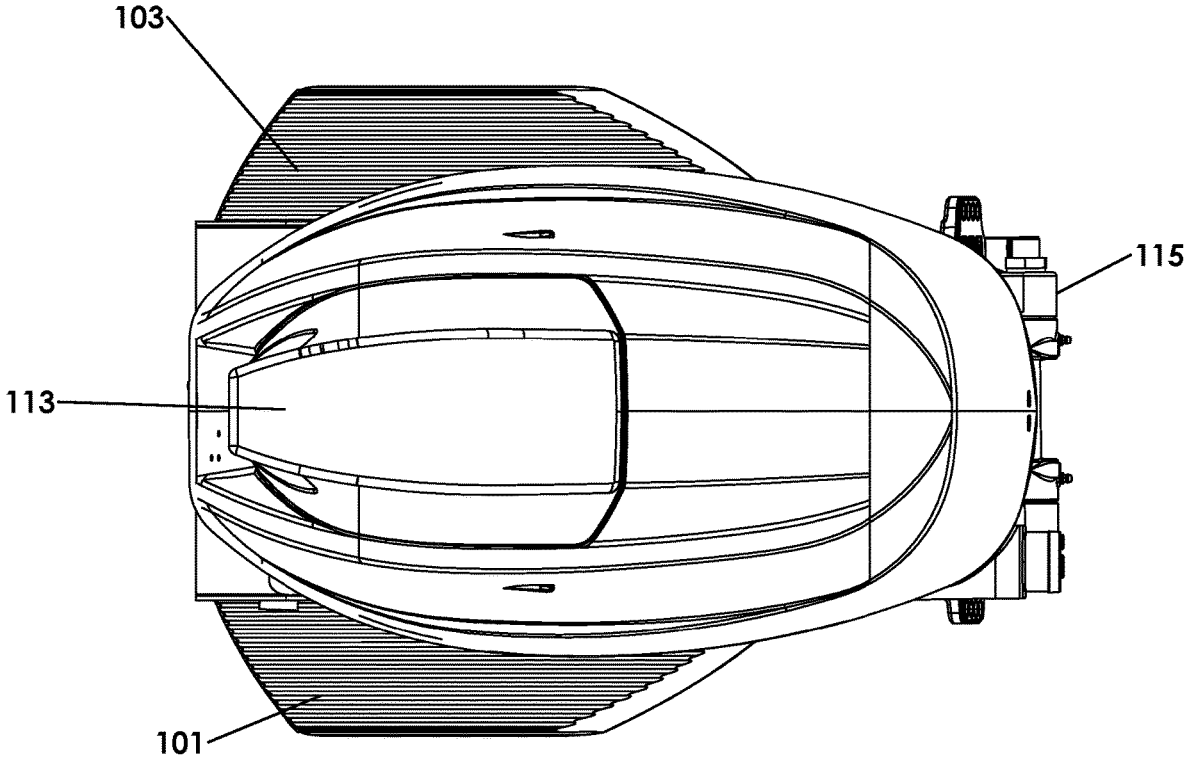
FIG. 5 is a top plan view of the marine propulsion system FIG. 1.
Figure 6:
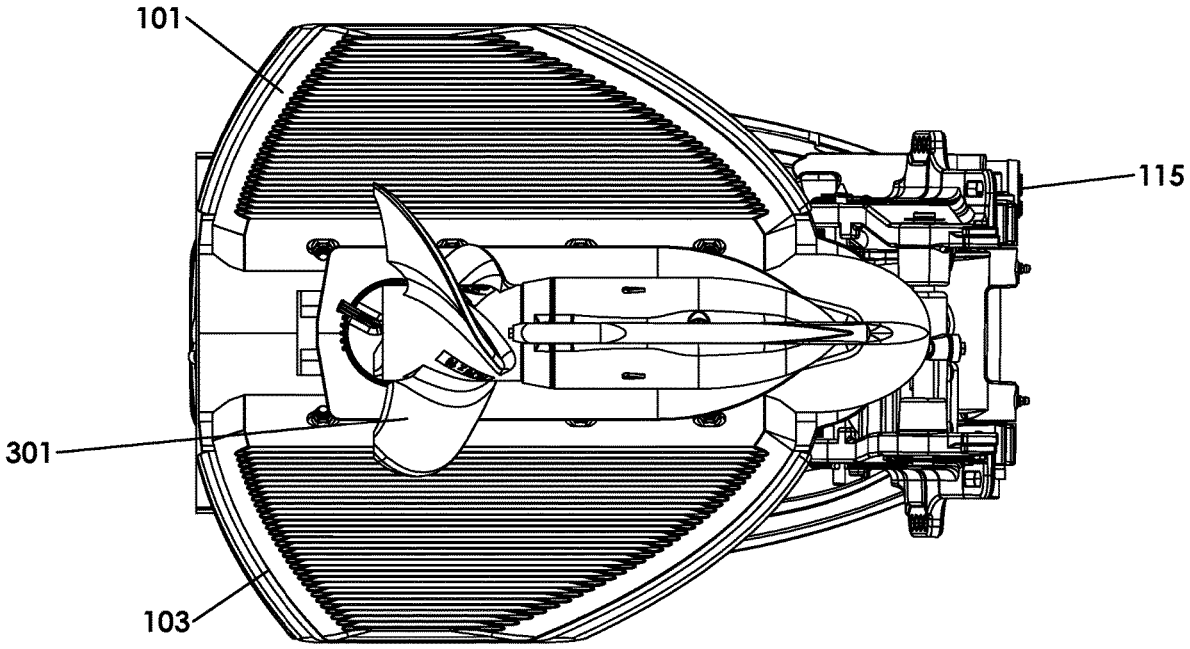
FIG. 6 is a bottom plan view of the marine propulsion system of FIG. 1.

FIG. 5 is a top plan view of the marine propulsion system of the present invention, and FIG. 6 is a bottom plan view of the marine propulsion system of the present invention.

Figure 7:
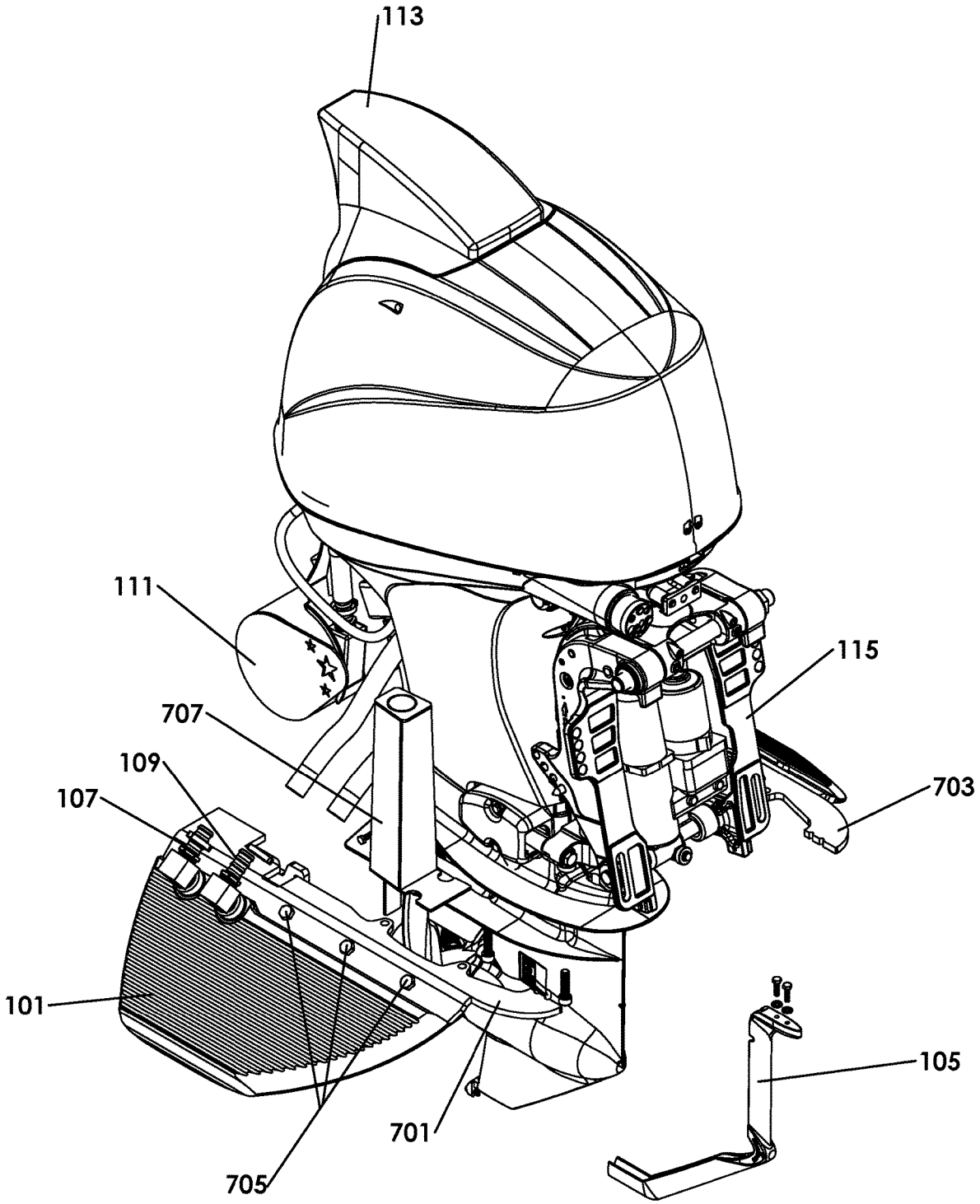
FIG. 7 is an exploded perspective view of the marine propulsion system of FIG. 1.

Turning now to FIG. 7, an exploded perspective view of the marine propulsion system of the present invention can be seen. A starboard heat exchanger bracket 701 can be seen along with a port side heat exchanger bracket 703. Each heat exchanger bracket is made from a metal such as stainless steel, aluminum, brass, or the like, and is fabricated as a stamped, machined, or otherwise manufactured part. Fasteners such as, but not limited to, bolts attach each heat exchanger to each heat exchanger bracket. The starboard heat exchanger mounting bolts 705 can be seen in FIG. 7. Each heat exchanger bracket is in turn mounted to the submerged drive unit in an area such as the anti-cavitation plate or the like.

In FIG. 7 an exhaust shroud 707 can be seen. The exhaust shroud is made from a suitable metal and is a structure that sits in the wet exhaust cavity of the marine propulsion system, as depicted in FIG. 7. Since the marine propulsion system does not expel water as it would in an open loop cooling arrangement, the exhaust is no longer cooled. This lack of cooling can cause the mid-section of the marine propulsion system to heat up to high temperatures that can discolor the marine propulsion system and possibly cause injury to the operator. The exhaust shroud 707 provides an air pocket that creates a thermal barrier and thus a layer of protection between the exhaust and the body of the marine propulsion system. The exhaust is now channeled through a tube that runs the length of the exhaust shroud 707, thus protecting the motor from excess heat by way of the pocket of air that surrounds the tube.

Also seen in FIG. 7 is the bumper 105 and means for attachment to the submerged drive unit. In the example depicted, bolts are used to attach the bumper 105 to an element of the marine propulsion system.

Figure 8:
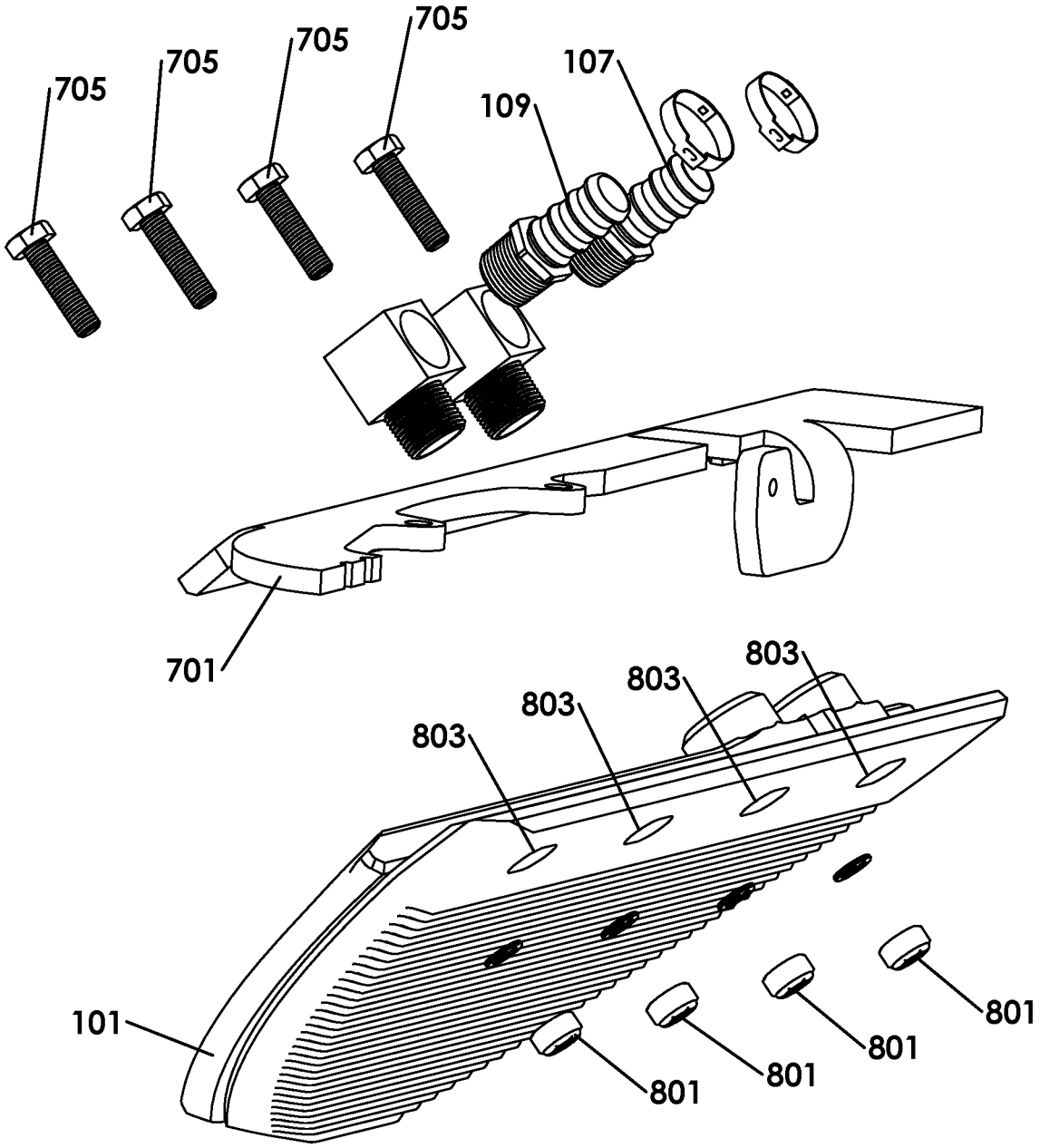
FIG. 8 is an exploded view of the starboard heat exchanger shown in FIG. 1.

FIG. 8 is an exploded view of the starboard heat exchanger 101. The starboard heat exchanger bracket 701 can be seen along with the starboard heat exchanger mounting bolts 705. To facilitate mounting of the starboard heat exchanger 101, starboard heat exchanger mounting holes 803 can be seen where the starboard heat exchanger mounting bolts 705 are placed therethrough. Starboard heat exchanger lock nuts 801 can be seen along with lock washers to retain and secure the starboard heat exchanger 101 by way of the starboard heat exchanger mounting bolts 705. Cooling ridges or fins can be seen on the starboard heat exchanger 101 to facilitate proper and efficient heat transfer.

Figure 9:
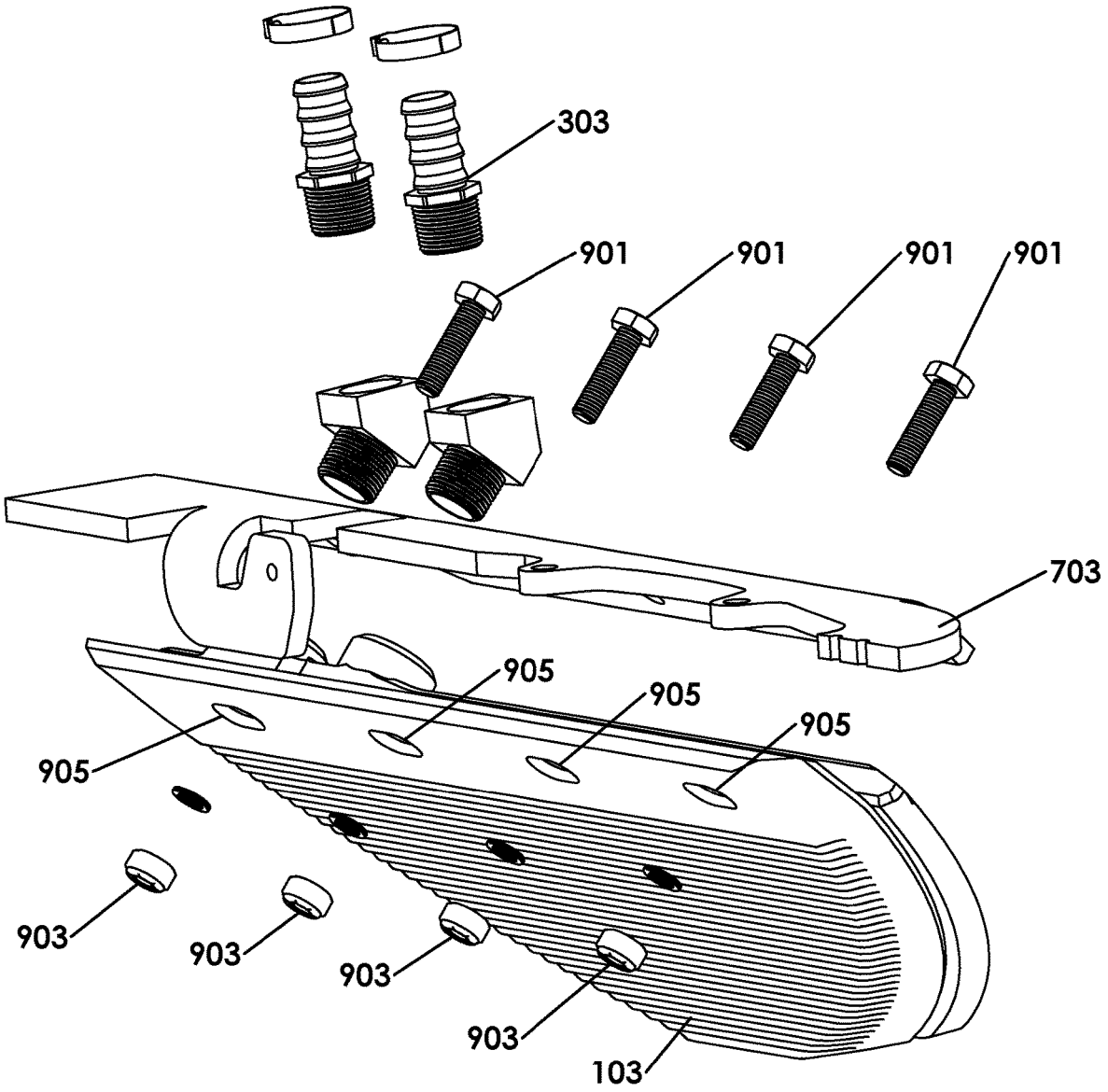
FIG. 9 is an exploded view of the port side heat exchanger shown in FIG. 1.

FIG. 9 is an exploded view of the port side heat exchanger 103. Similar to the starboard heat exchanger 101, the port side heat exchanger bracket 703 can be seen along with the port side heat exchanger mounting bolts 901. To facilitate mounting of the port side heat exchanger 103, port side heat exchanger mounting holes 905 can be seen where the port side heat exchanger mounting bolts 901 are placed therethrough. Port side heat exchanger lock nuts 903 can be seen along with lock washers to retain and secure the port side heat exchanger 103 by way of the port side heat exchanger mounting bolts 901. Cooling ridges or fins can be seen on the port side heat exchanger 103 to facilitate proper and efficient heat transfer.

Figure 10:
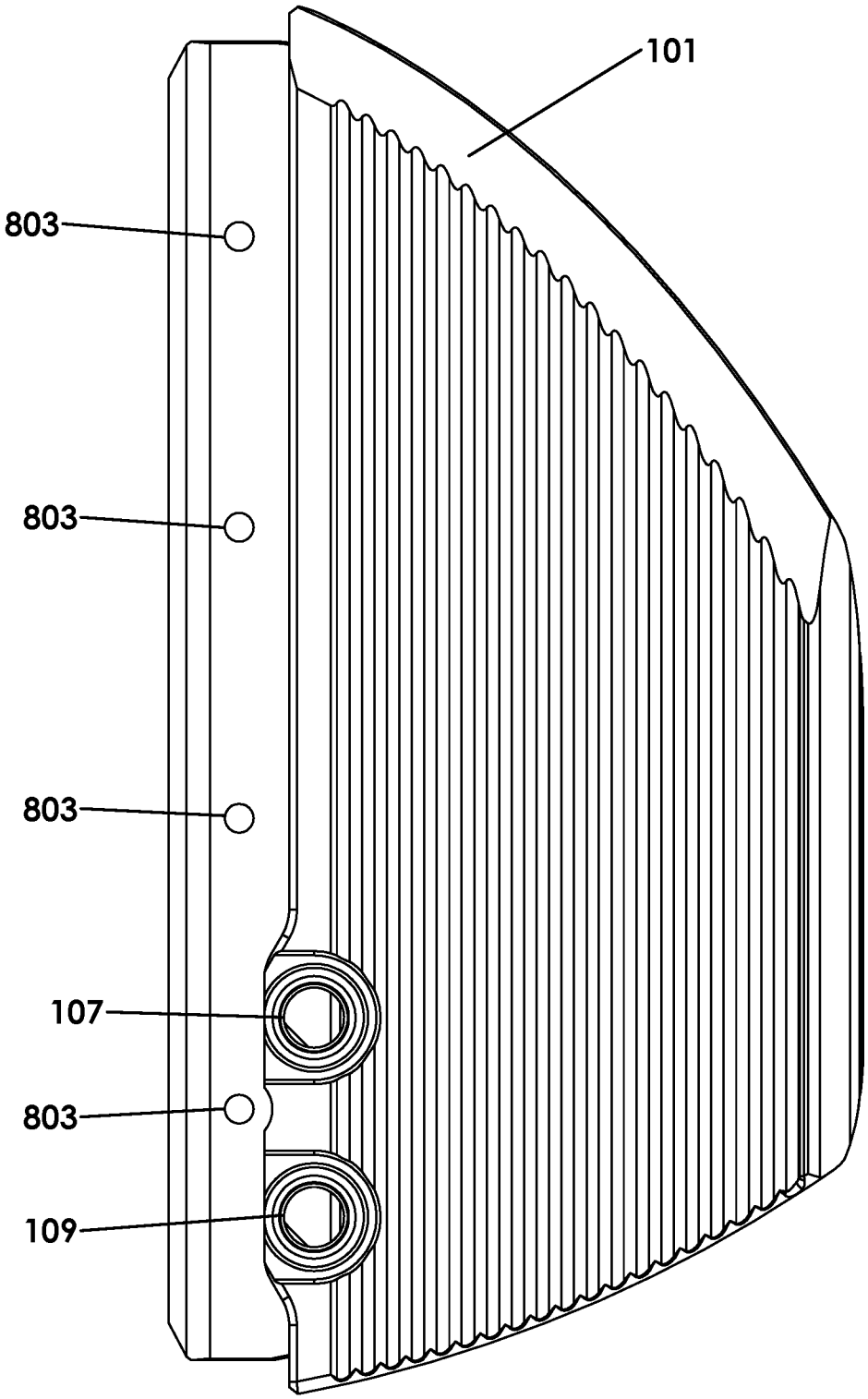
FIG. 10 is a top plan view of the starboard heat exchanger.

FIG. 10 is a top plan view of the starboard heat exchanger 101 that further details the first coolant line 107 and the second coolant line 109 as well as starboard heat exchanger mounting holes 803.

Figure 11:
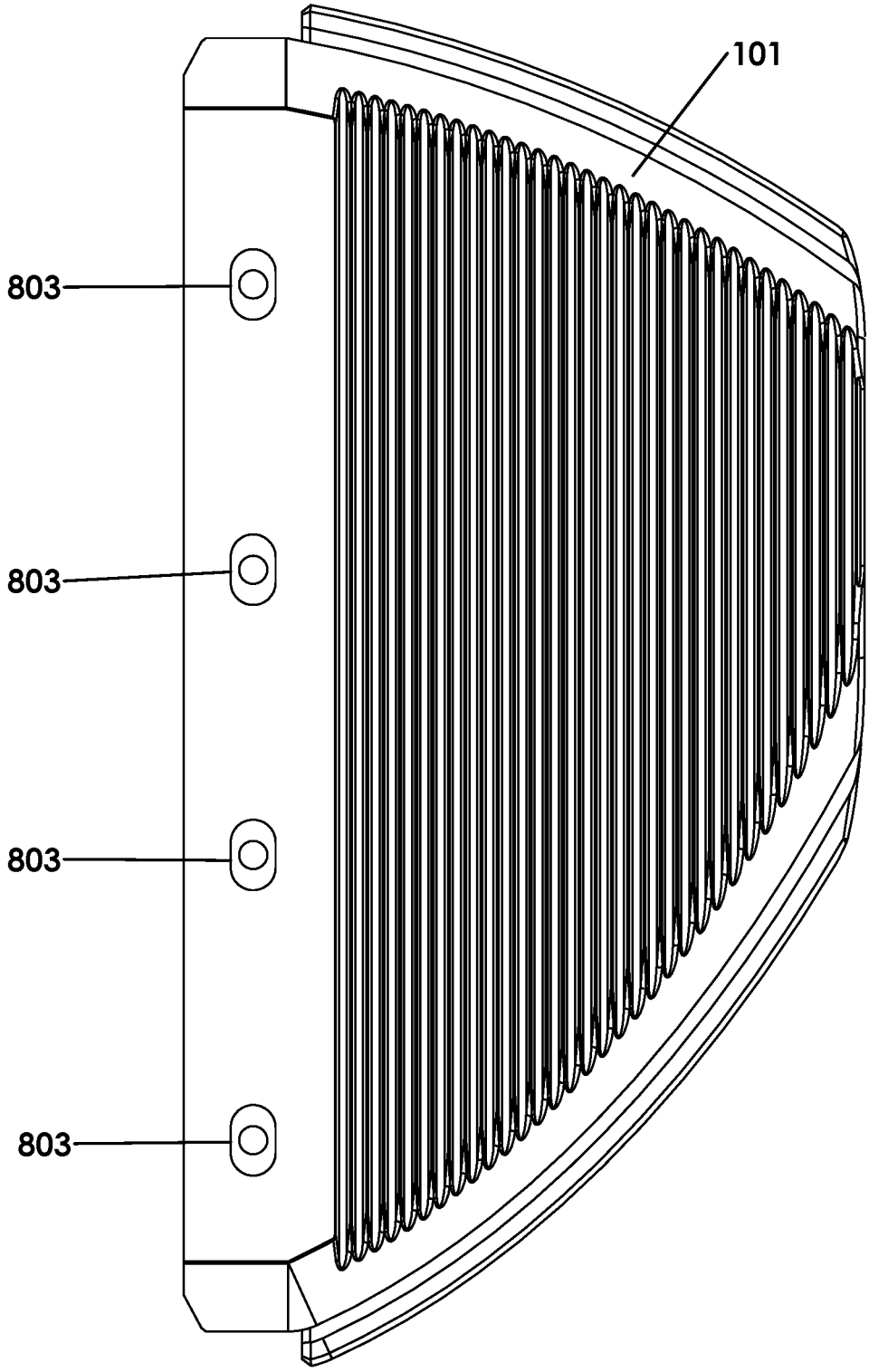
FIG. 11 is a bottom plan view of the starboard heat exchanger.

FIG. 11 is a bottom plan view of the starboard heat exchanger 101 also showing the cooling fins or ridges and the overall geometry of the starboard heat exchanger 101.

Figure 12:
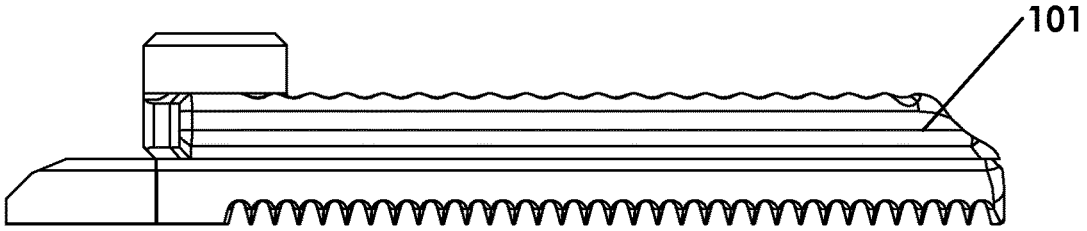
FIG. 12 is a side view of the starboard heat exchanger.
Figure 13:
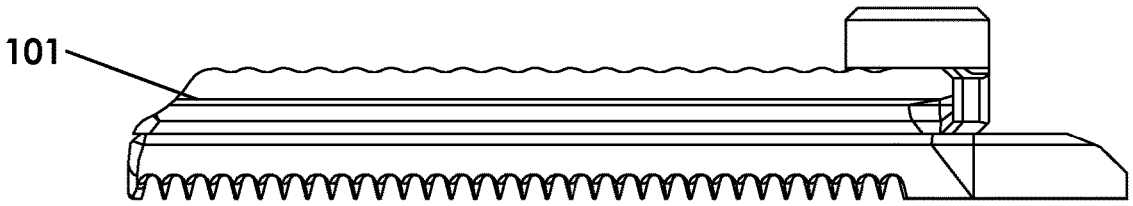
FIG. 13 is an alternate side view of the starboard heat exchanger.

FIG. 12 is a side view of the starboard heat exchanger 101 and FIG. 13 is an alternate side view of the starboard heat exchanger 101.

Figure 14:
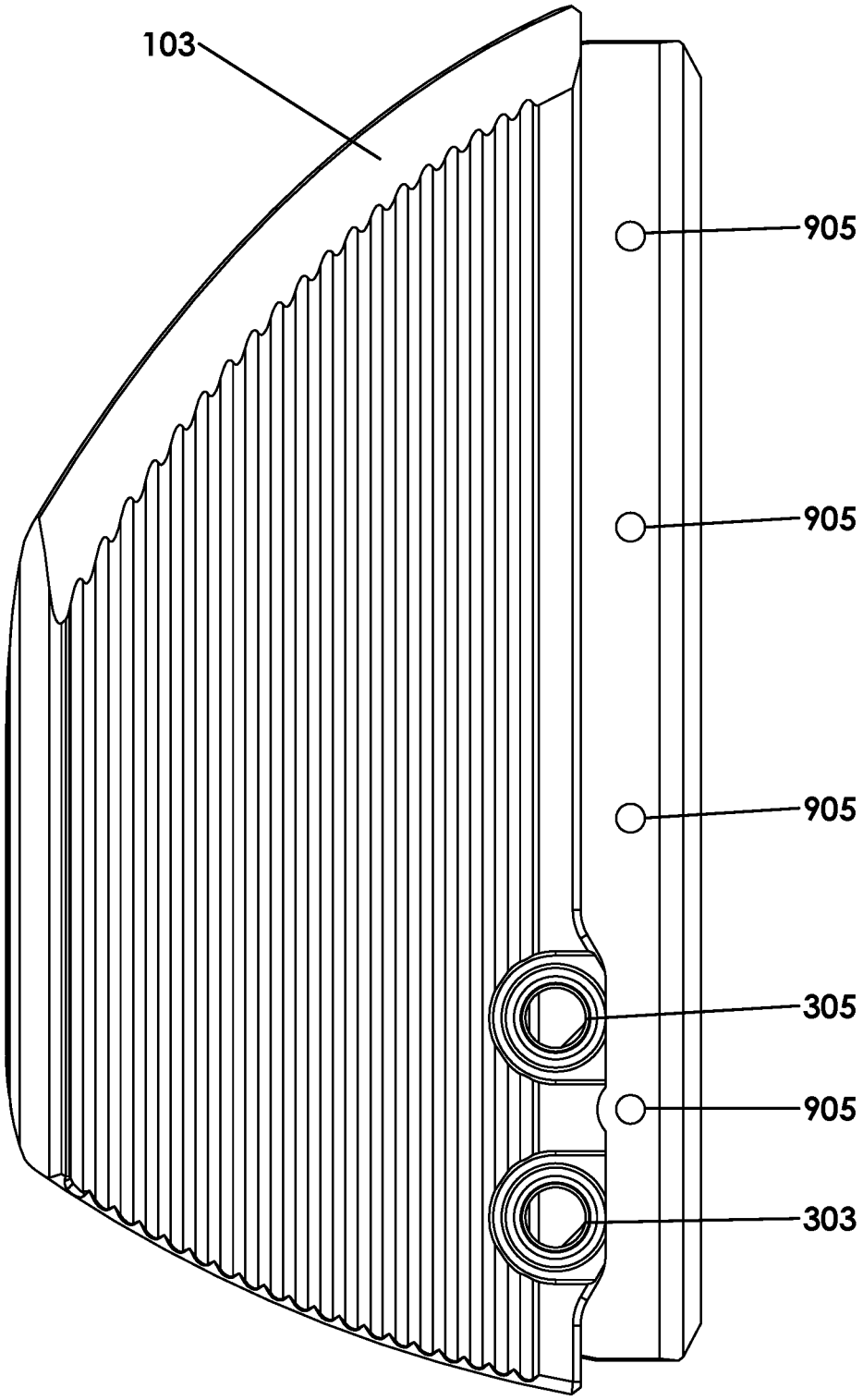
FIG. 14 is a top plan view of the port side heat exchanger.

FIG. 14 is a top plan view of the port side heat exchanger 103. Like the previous figures of the starboard side heat exchanger 101, the third coolant line 303 and the fourth coolant line 305 as well as the port side heat exchanger mounting holes 905 can be seen.

Figure 15:
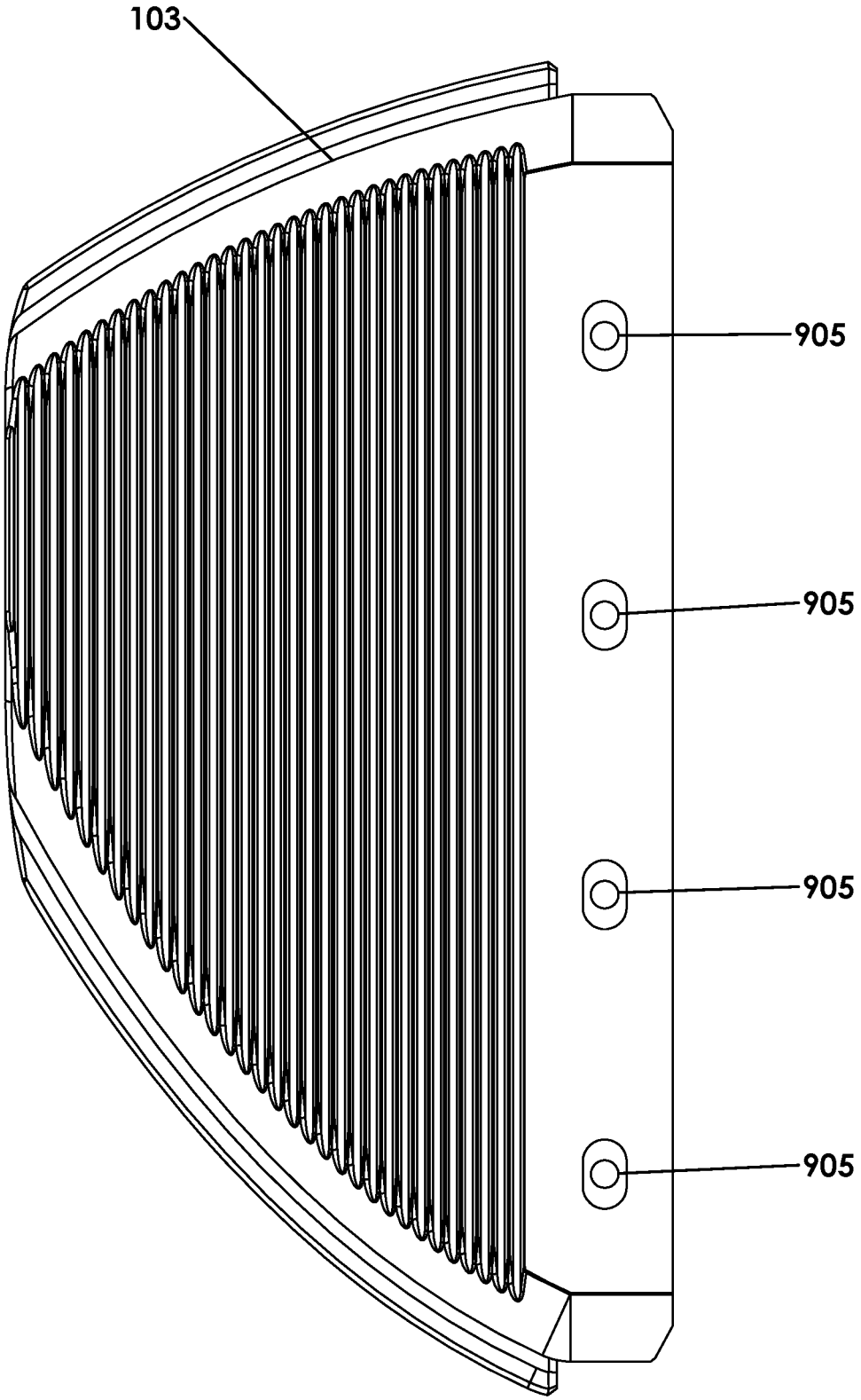
FIG. 15 is a bottom plan view of the port side heat exchanger.

FIG. 15 is a bottom plan view of the port side heat exchanger 103 also showing the cooling fins or ridges and the overall geometry of the port side heat exchanger 103.

Figure 16:
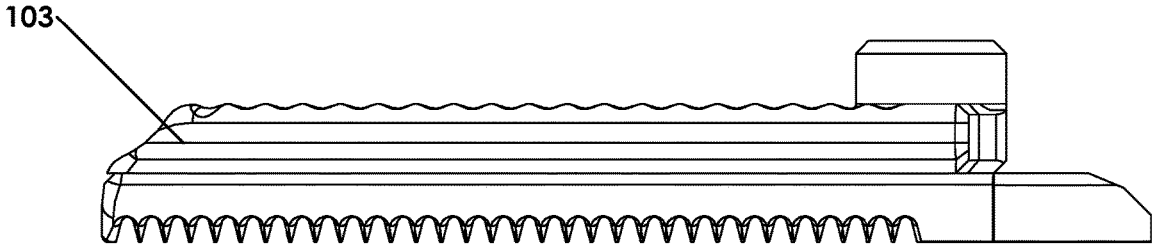
FIG. 16 is a side view of the port side heat exchanger.
Figure 17:
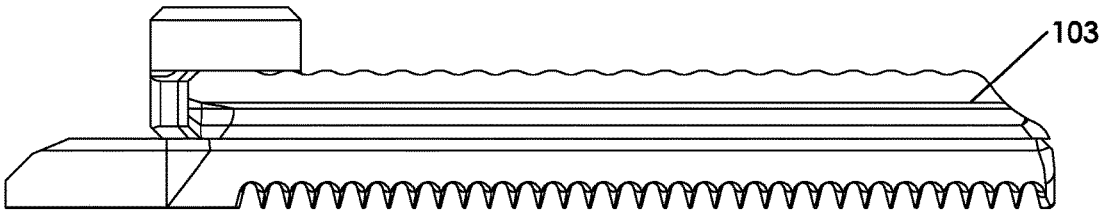
FIG. 17 is an alternate side view of the port side heat exchanger.

FIG. 16 is a side view of the port side heat exchanger 103 and FIG. 17 is an alternate side view of the port side heat exchanger 103.

Figure 18:
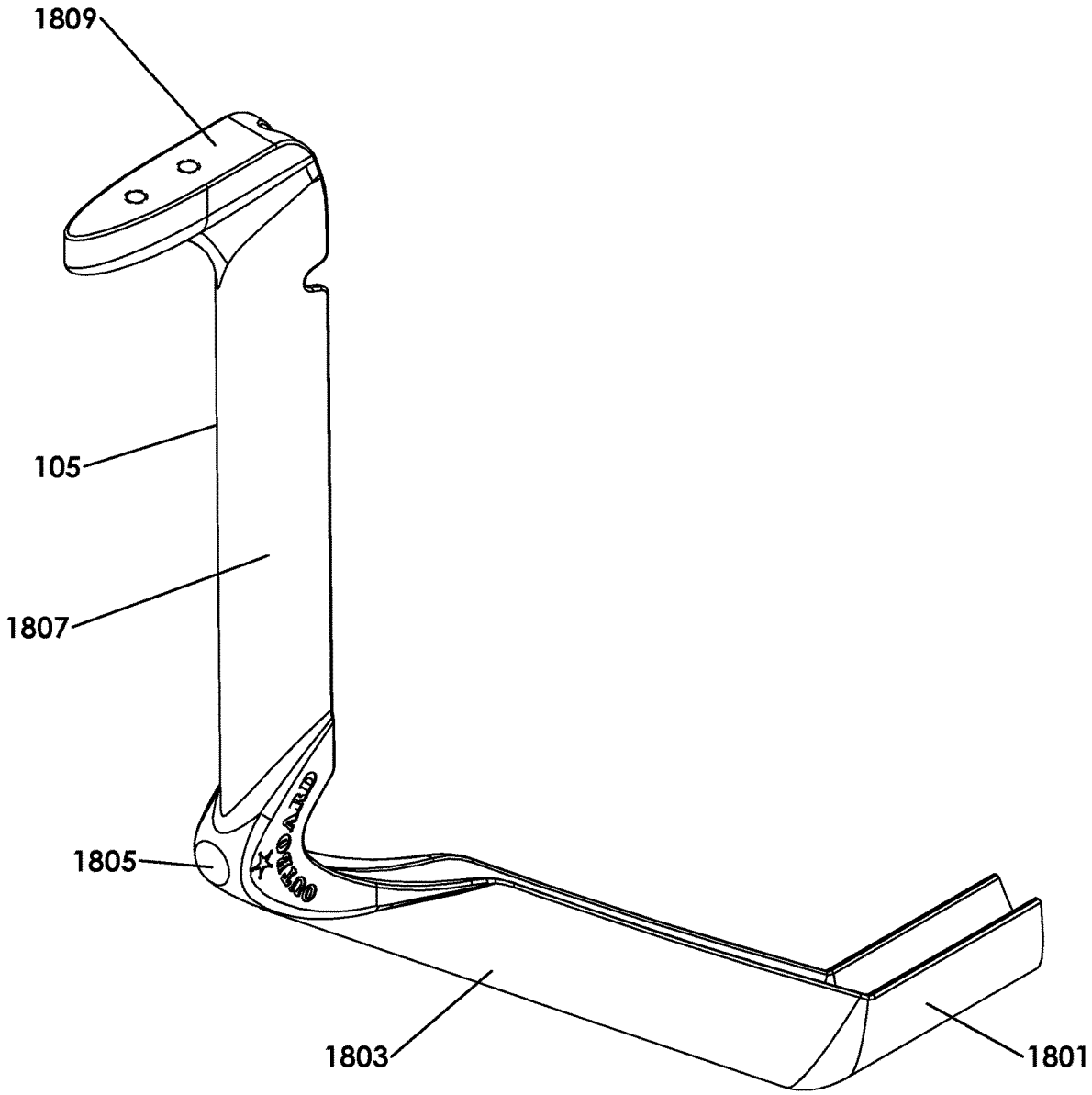
FIG. 18 is a perspective view of a bumper for the marine propulsion system of the present invention.

FIG. 18 is a perspective view of the bumper 105 for the marine propulsion system of the present invention. The bumper 105 serves to protect the leading edge of the marine propulsion system and comprises a skeg cradle 1801, a skeg leading edge cover 1803, a gear housing cover 1805, a leading edge cover 1807 and a heat exchanger bracket mount 1809. The heat exchanger bracket mount 1809 has mounting features such as holes or the like that serve to facilitate attachment of the bumper cover 105 to the marine propulsion system of the present invention. In one embodiment, the heat exchanger bracket mount 1809 mounts to the heat exchanger brackets which in turn mount up through the anti-cavitation plate such that the bumper 105 does not mount direct to the motor. FIG. 1 shows the bumper cover 105 installed and in use, and FIG. 7 shows an exploded view thereof. The bumper cover has a channel or v shaped configuration to allow for attachment to the marine propulsion system of the present invention. The angles at which the channel or v shaped configuration are formed may vary depending on the exact submerged drive unit geometry.

Figure 19:
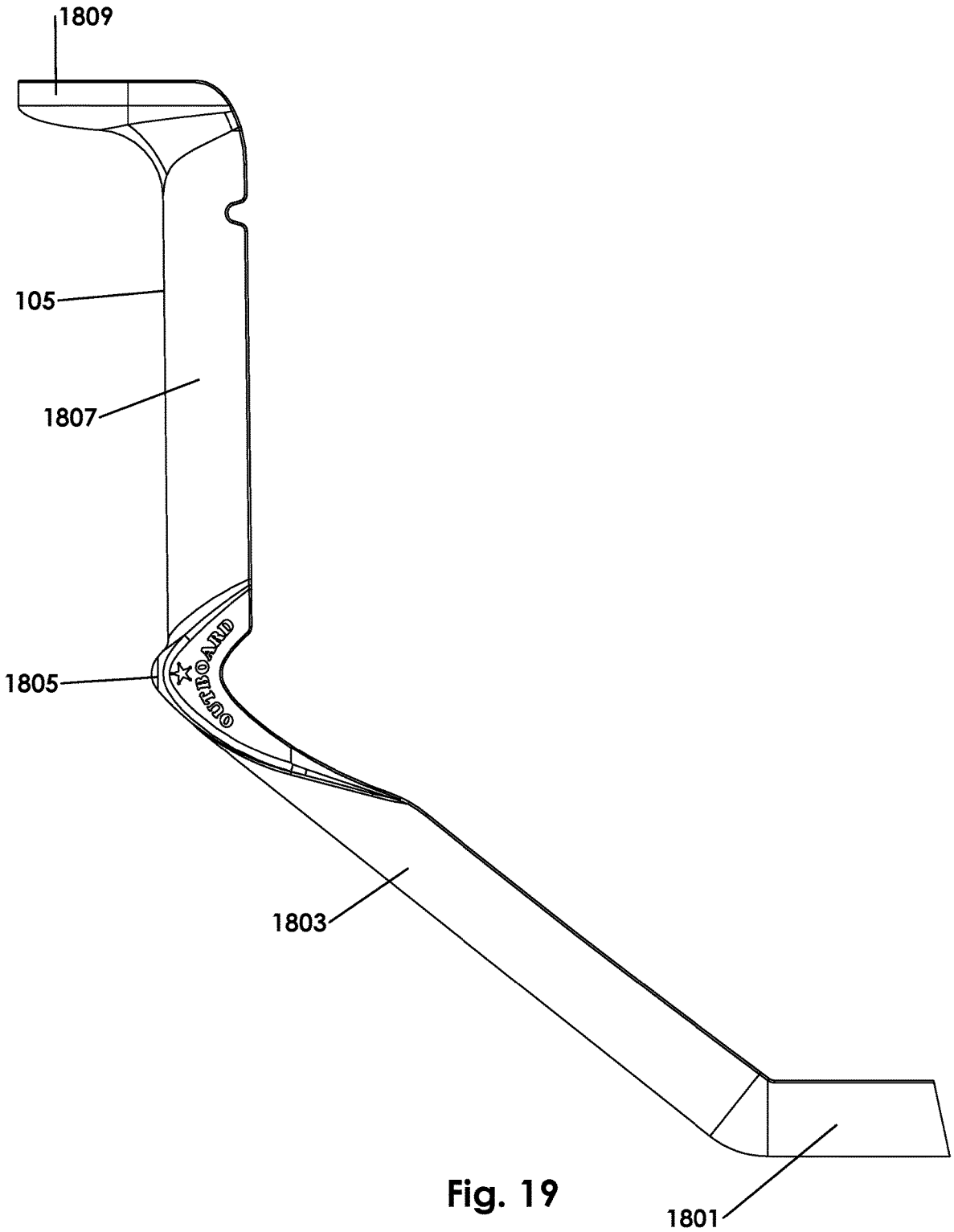
FIG. 19 is a profile view of the bumper of FIG. 18.
Figure 20:
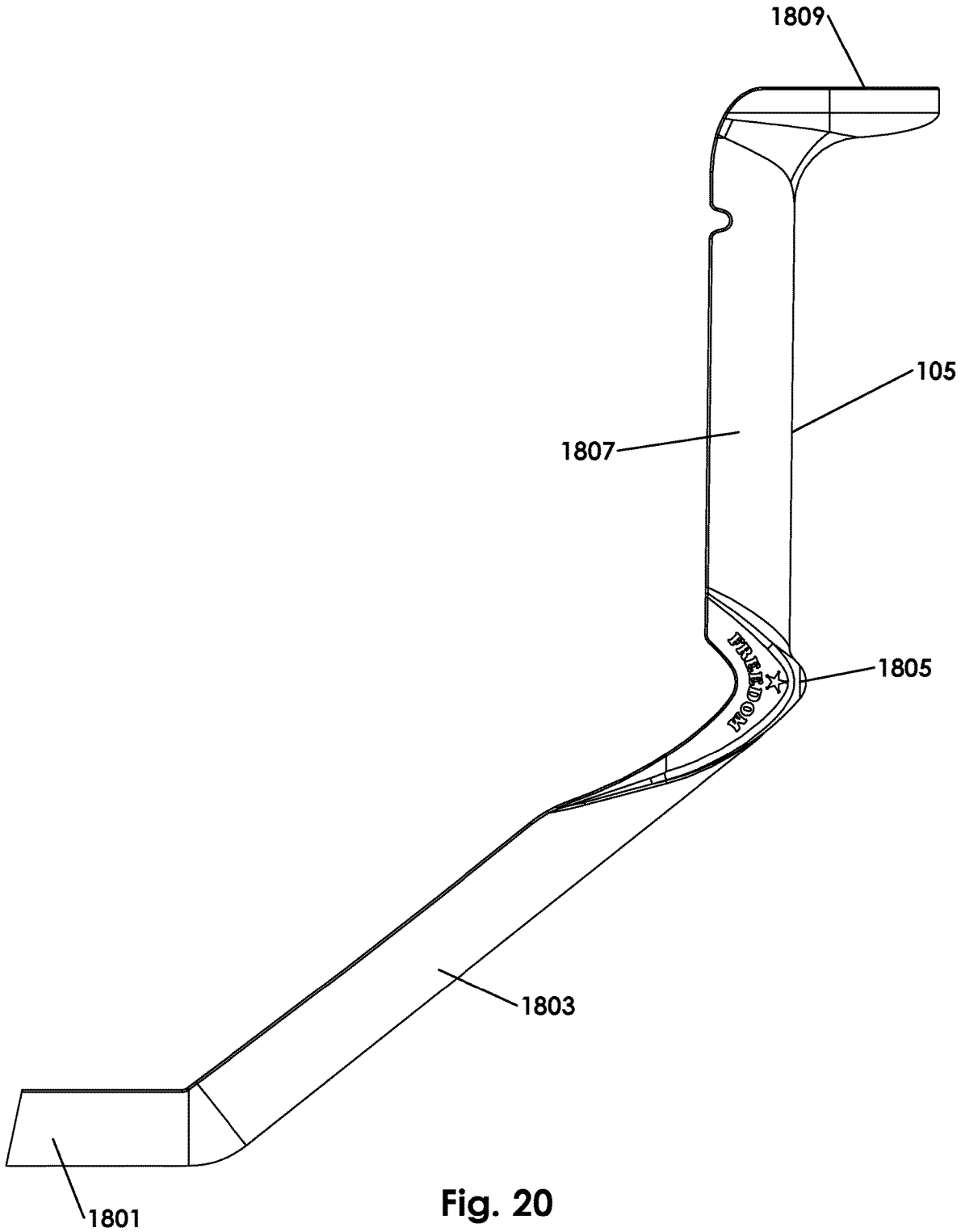
FIG. 20 is an alternate profile view of the bumper of FIG. 18.
Figure 21:
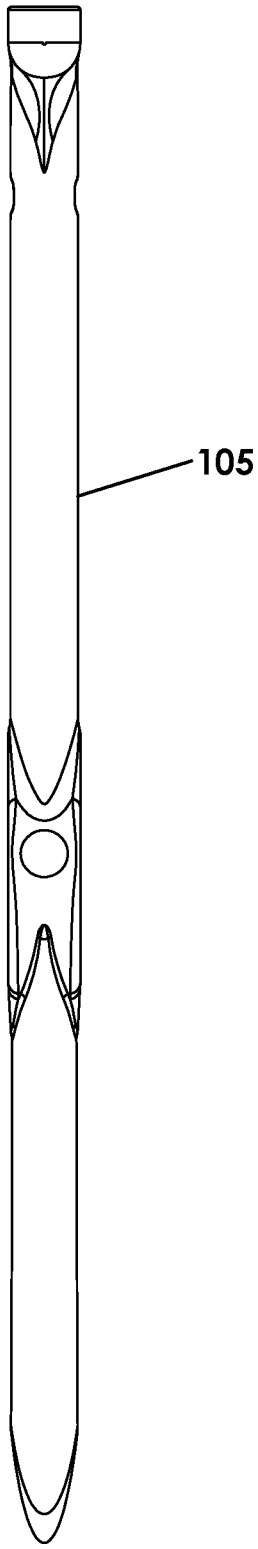
FIG. 21 is a front plan view of the bumper of FIG. 18.
Figure 22:
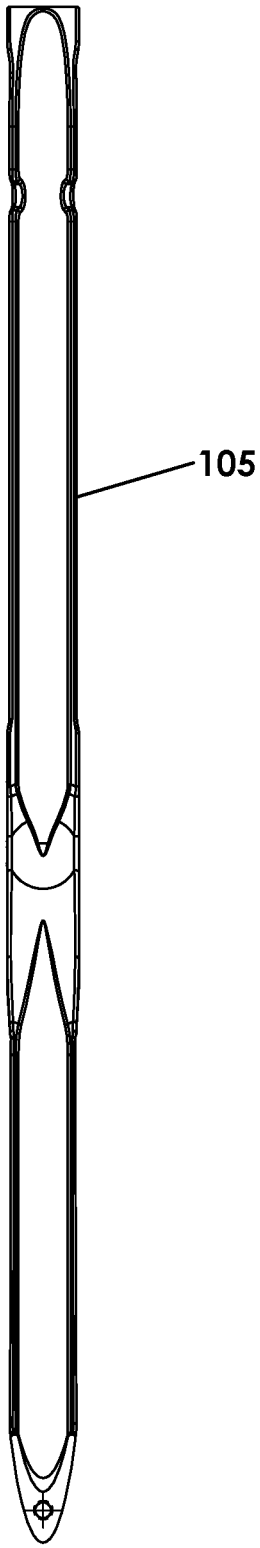
FIG. 22 is rear plan view of the bumper of FIG. 18.
Figure 23:
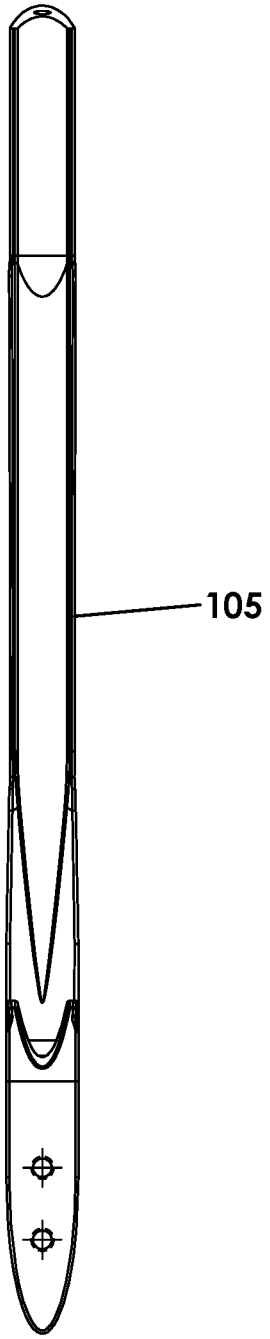
FIG. 23 is a top plan view of the bumper of FIG. 18.
Figure 24:
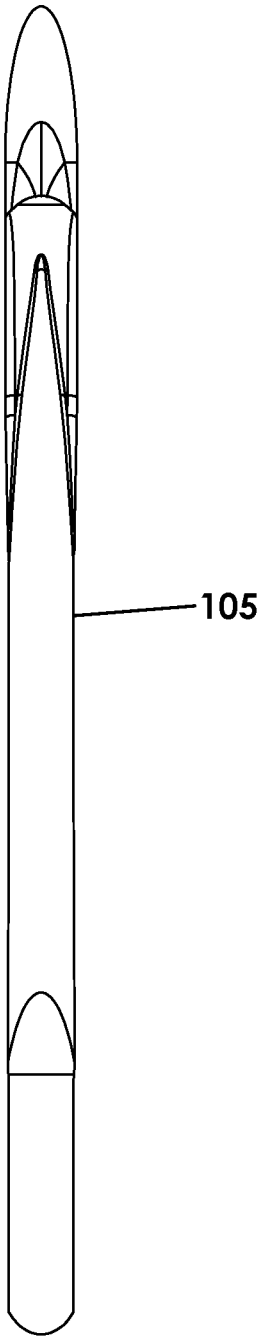
FIG. 24 is a bottom plan view of the bumper of FIG. 18.

FIG. 19 is a profile view of the bumper 105, FIG. 20 is an alternate profile view of the bumper 105, FIG. 21 is a front plan view of the bumper 105, FIG. 22 is rear plan view of the bumper 105, FIG. 23 is a top plan view of the bumper 105, and FIG. 24 is a bottom plan view of the bumper 105.

While the closed loop coolant system of the present invention offers benefits related to the reduction or elimination of corrosion due to salt water operation, it also offers substantial benefits when operating in shallow, debris laden, or otherwise obstructed waterways such as marshes, swamps, or the like. The novel closed loop coolant system of the present invention serves to prevent mud, debris, or other fouling materials from entering the cooling system of the marine propulsion system and blocking the small coolant passageways within the system.

An optional surface drive extension, as will be further described and depicted herein, assists cutting through mud and debris to create more of a path for water to collect and thus provide the propeller with more propulsion capabilities, allowing one to operate in severe shallow areas for an extended amount of time.

Figure 25:
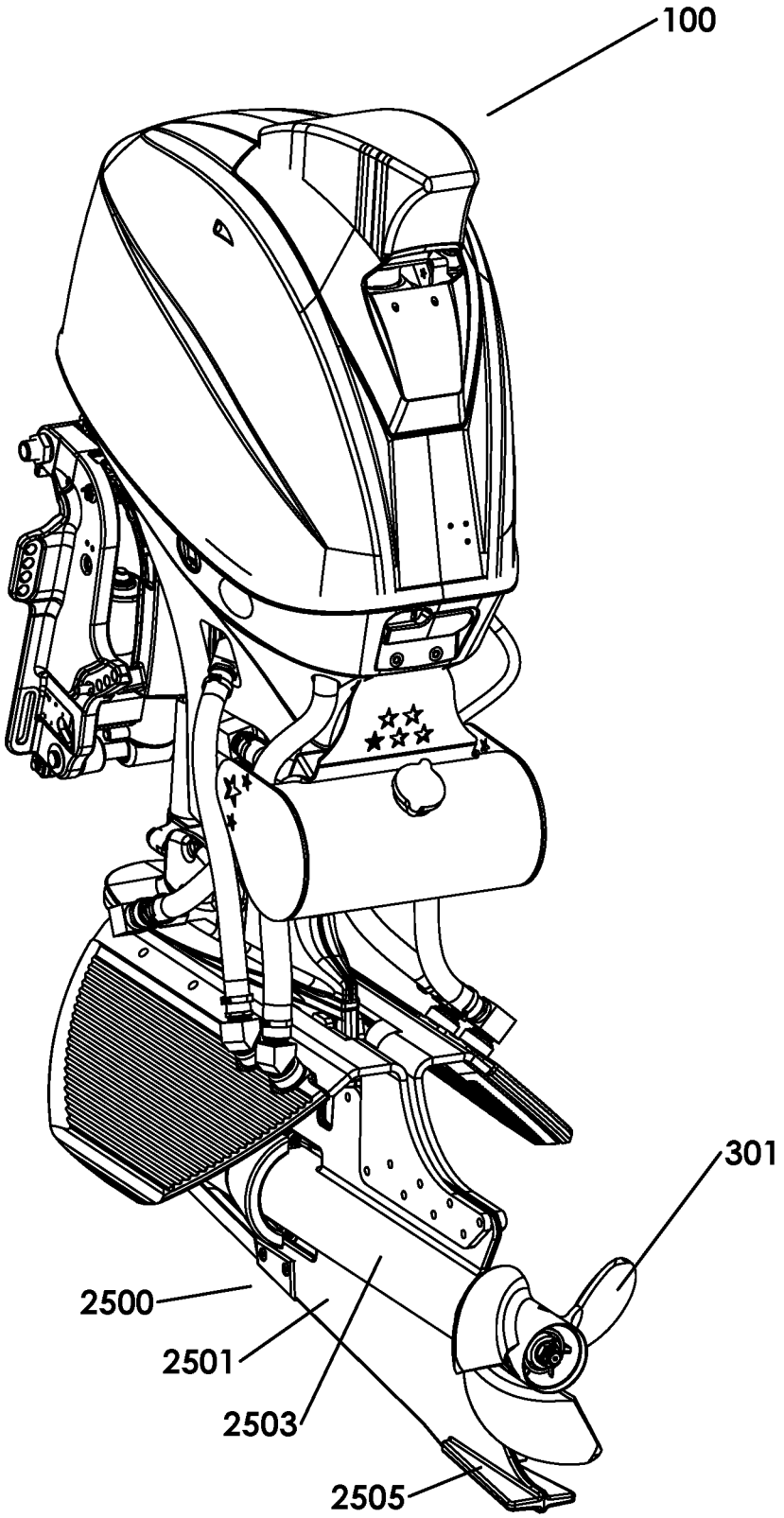
FIG. 25 is a perspective view of the marine propulsion system with a closed coolant loop in accordance with the present invention and with a surface drive extension installed.

FIG. 25 is a perspective view of the marine propulsion system with a closed coolant loop in accordance with the present invention and with a surface drive extension 2500 installed. The surface drive extension 2500, as will be further described herein, extends the driveline length through an extension shaft and related housing and mechanism. The housing for the extension shaft and related components may, in some embodiments, comprise a skeg 2501 for protection of the surface drive extension and propeller as well as improved hydrodynamic performance. The skeg is configured as a vertically planar component that may, in some embodiments, have skeg foils 2505 mounted perpendicular to the bottom of the skeg 2501 for increased protection of the propeller and surface drive extension as well as improved hydrodynamic performance. In some embodiments of the present invention, the skeg foils 2505 are triangular, trapezoidal, rectangular, or the like. A drive tunnel 2503 can be seen in FIG. 25 that contains the extension shaft and related components. The surface drive extension mounts to the existing propeller mount in order to move the propeller outward from the submerged drive unit. The surface drive extension is made from a metal such as aluminum, stainless steel, brass, or the like.

Figure 26:
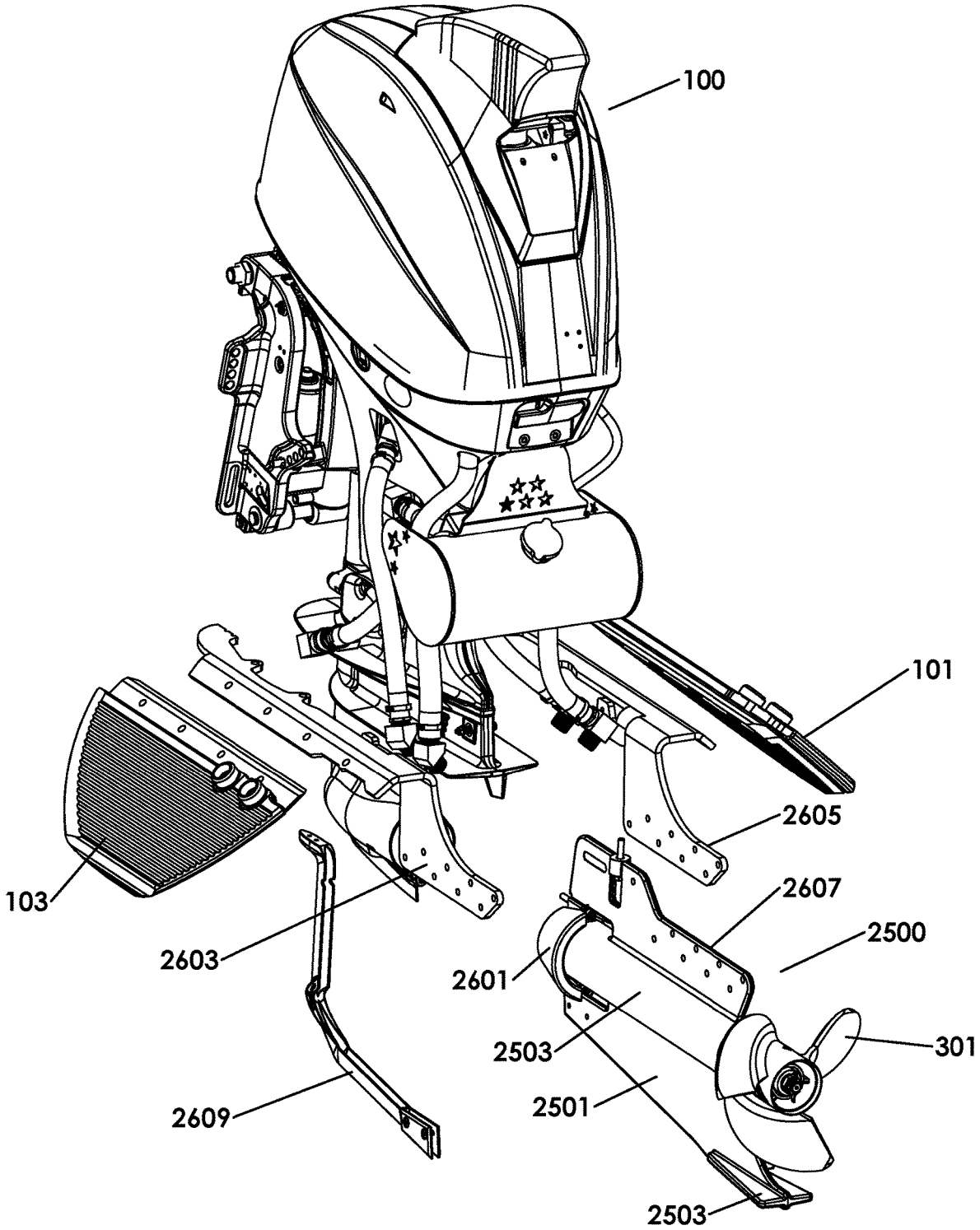
FIG. 26 is an exploded view of the marine propulsion system of FIG. 25.

FIG. 26 is an exploded view of the marine propulsion system with a closed coolant loop 100 and a surface drive extension 2500. A mounting fin 2607 can be seen for attachment of the surface drive extension 2500 to the marine propulsion system. The mounting fin 2607 also allows for the attachment of both the starboard heat exchanger extended bracket 2605 and the port side heat exchanger extended bracket 2603. A coupling 2601 can be seen that facilitates the release of exhaust pressure from water rushing by. Without this conical coupling, there would be undesirable back pressure in the system.

the connection of the surface drive extension 2500 to the existing marine propulsion system. To facilitate increased protection for the marine propulsion system of the present invention, a mud bumper 2609 is employed. The mud bumper 2609 has an elongated or extended geometry to accommodate the surface drive extension 2500 and it's associated skeg 2501. The mud bumper 2609 also may be reinforced or otherwise more durable than the standard bumper 105.

Figure 27:
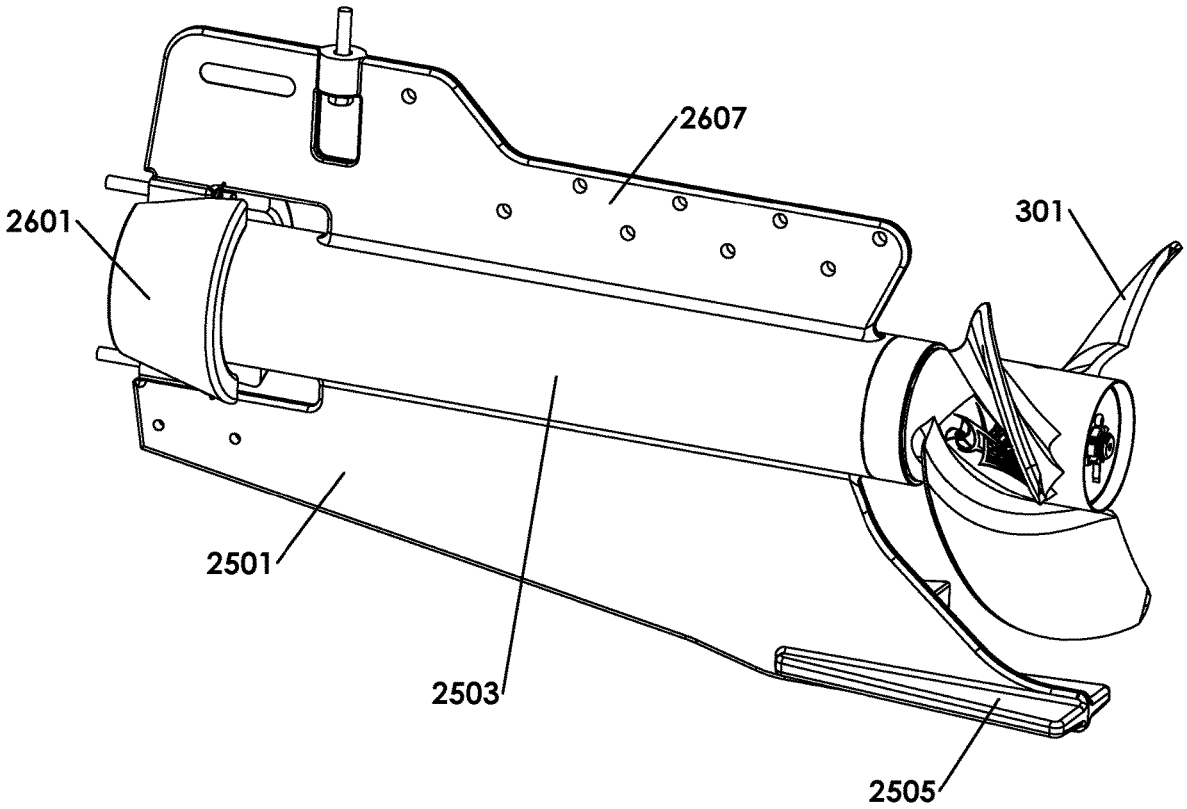
FIG. 27 is a perspective view of a surface drive extension in accordance with the present invention.

FIG. 27 is a perspective view of the surface drive extension 2500 with an optional weedless propeller 301 installed. The drive tunnel 2503 can be seen along with the skeg 2501, skeg foils 2505, mounting fin 2607 and coupling 2601.

Figure 28:
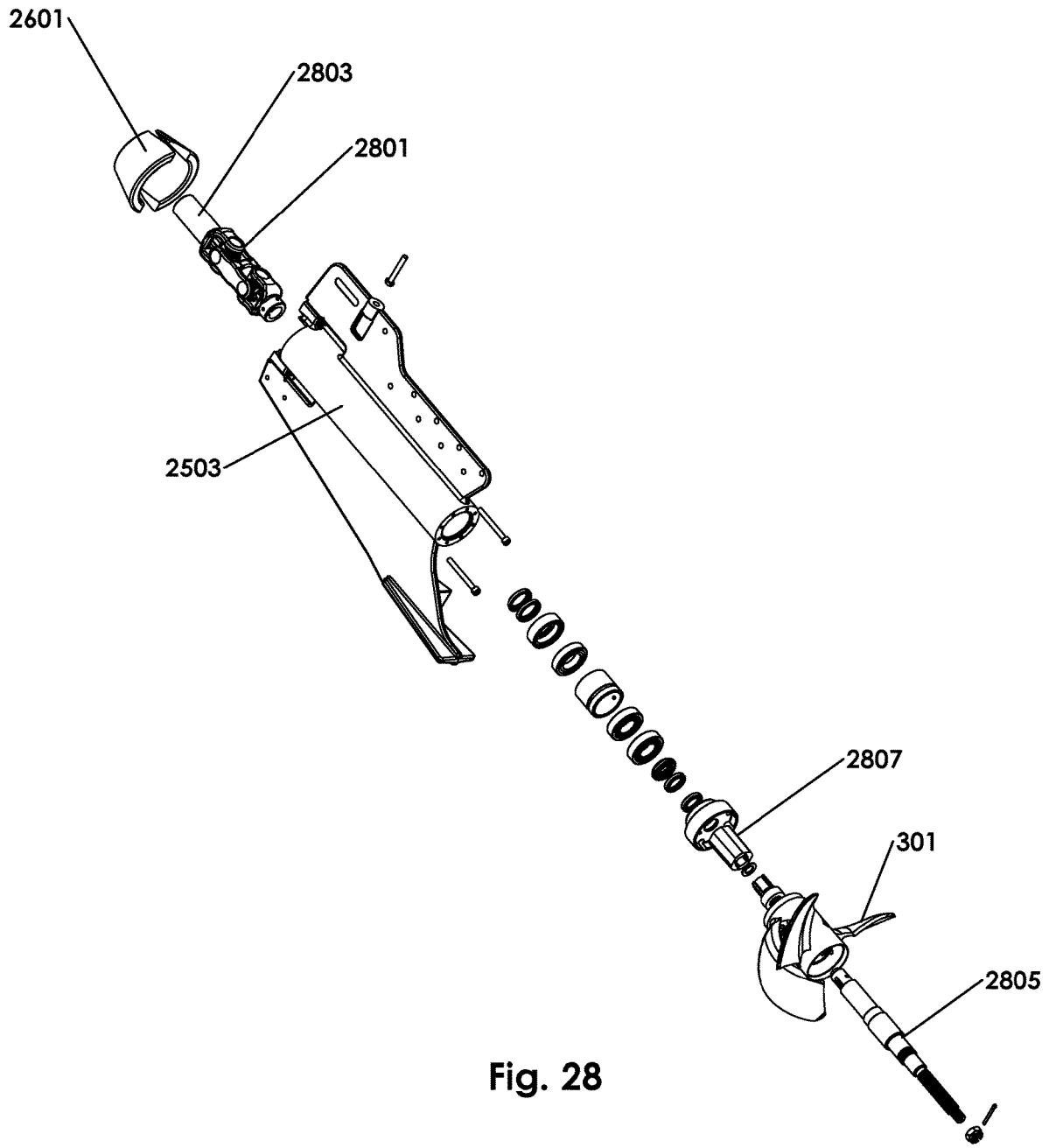
FIG. 28 is an exploded view of the surface drive extension of FIG. 27.

FIG. 28 is an exploded view of the surface drive extension 2500 showing the internal mechanism thereof. A universal joint assembly 2801 can be seen with a drive shaft coupling 2803 on one end and an extension shaft 2805 on the other end. The drive shaft coupling 2803 comprises an adapter for axially coupling to a horizontal output shaft of an outboard motor driveline such as the marine propulsion system of the present invention. A series of bearing assemblies guide and support the overall driveline and extension shaft 2805. The weedless propeller 301 is attached to the extension shaft 2805 by way of a propeller hub 2807 or other suitable mechanism. The overall driveline assembly within the drive tunnel 2503 and related housing is sealed in order to prevent ingress of water.

Should the marine propulsion system encounter a submerged obstacle such as a log, rocks, a tree stump, or the like, a break away jack plate 2900 is provided in some embodiments of the present invention. The break away jack plate 2900 allows for the attachment of the marine propulsion system to the transom of a boat as well as movement of the marine propulsion system either by the operator or through inadvertent contact with a submerged obstacle.

Figure 29:
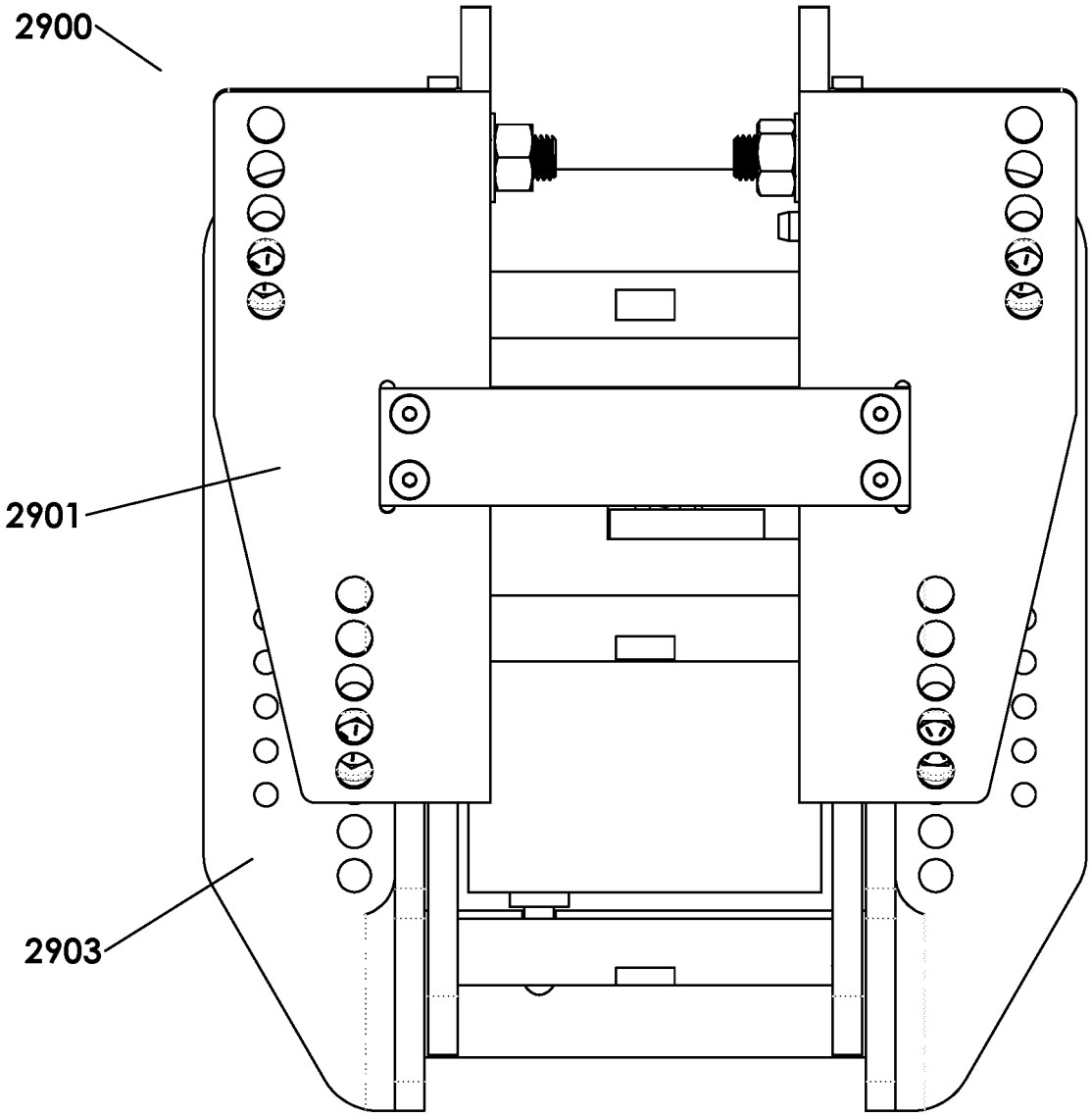
FIG. 29 is a plan view of a breakaway jack plate in accordance with the present invention.

FIG. 29 is a plan view of a breakaway jack plate 2900. The breakaway jack plate provides for not only a breakaway mounting for the marine propulsion system of the present invention, but also allows for shallow obstructed water operation of the marine propulsion system of the present invention. The breakaway jack plate is fabricated from a metal such as aluminum, steel, stainless steel, brass, titanium, a metal alloy, or the like. In FIG. 29 a motor mount 2901 and a transom mount 2903 can be seen mechanically coupled together. As will be seen in FIGS. 30-34, the motor mount 2901 and the transom mount 2903 are hingeably connected by way of a cam plate (see FIG. 33, 3301) such that the motor mount 2901 pivots or moves in relation to the transom mount 2903. Both the motor mount 2901 and the transom mount 2903 have a plurality of holes for mounting to the marine propulsion system (the motor) and the transom respectively.

Figure 30:
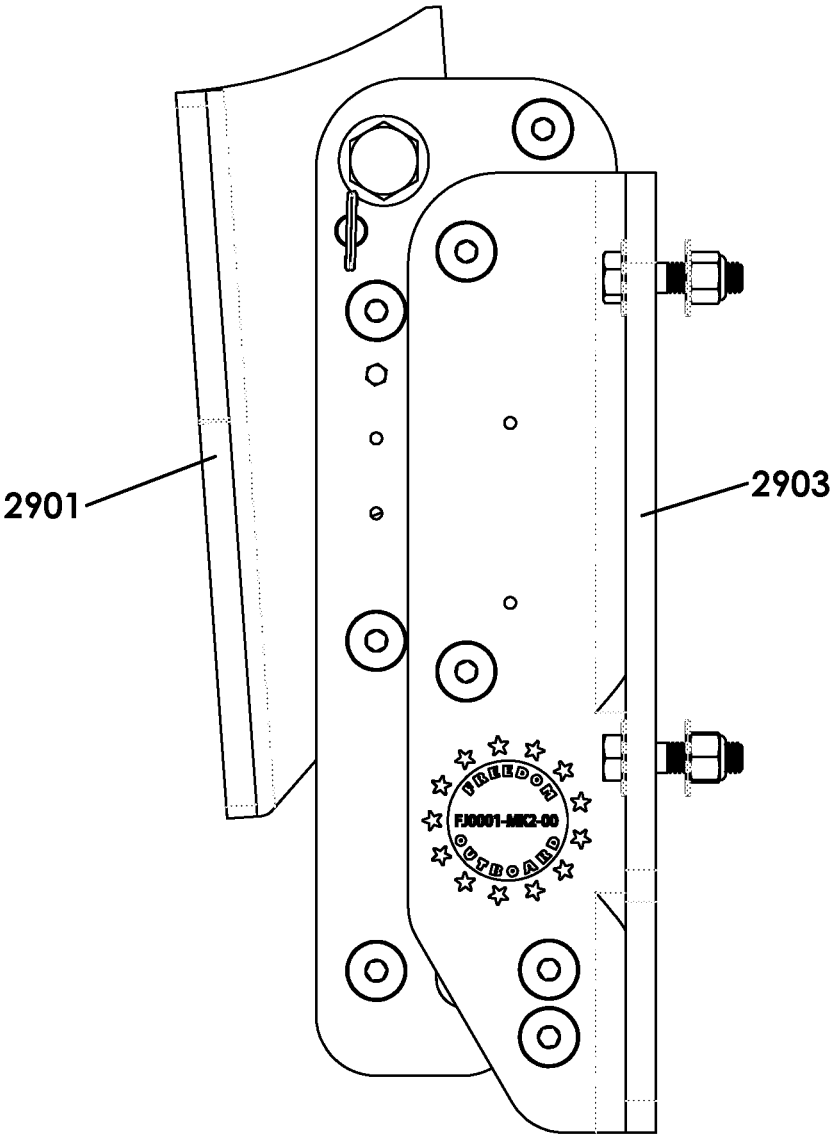
FIG. 30 is a side view of the breakaway jack plate of FIG. 29.

FIG. 30 is a side view of the breakaway jack plate 2900 showing bolts through the transom mount 2903 as well as the motor mount 2901.

Figure 31:
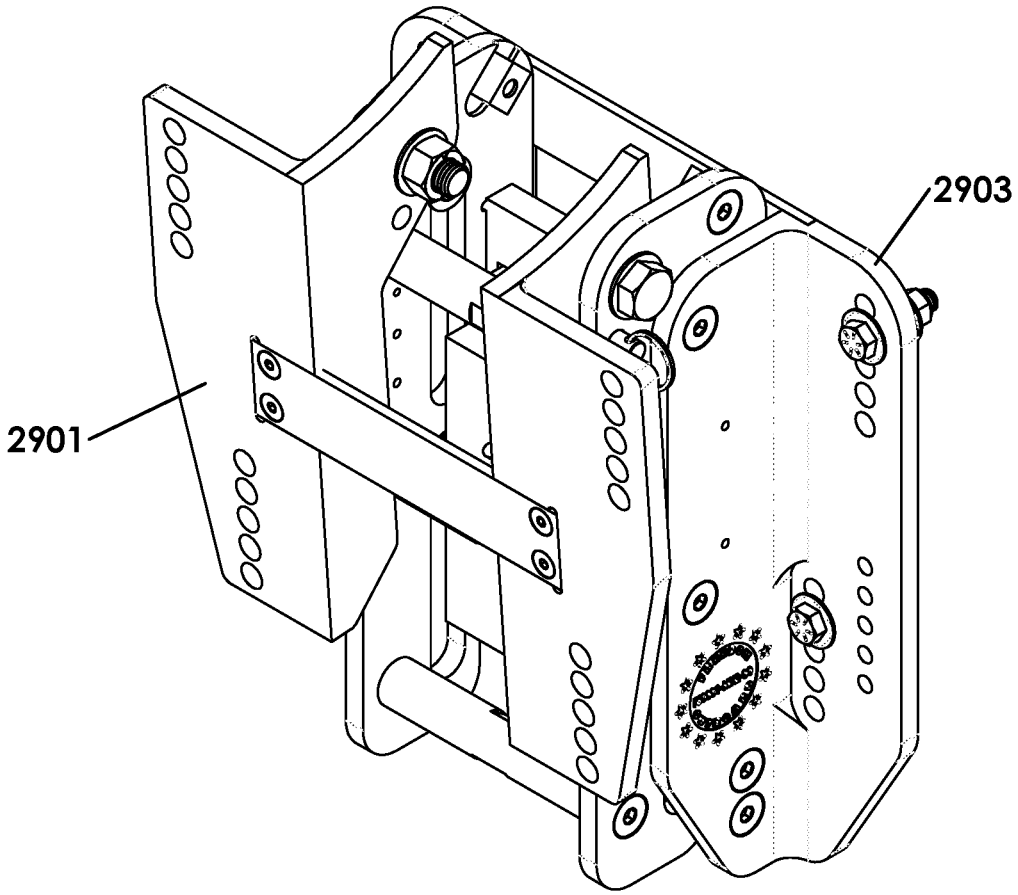
FIG. 31 is a perspective view of the breakaway jack plate of FIG. 29.

FIG. 31 is a perspective view of the breakaway jack plate 2900 showing the motor mount 2901 hingeably attached by way of a cam plate (see FIG. 33, 3301) to the transom mount 2903 by way of bolts attached therethrough.

A release pin may also be employed to allow the motor mount 2901 to move in relation to the transom mount 2903 if the release pin is removed and alternatively maintaining rigidity of the motor mount 2901 to the transom mount 2903 when the release pin is in place. The release pin serves as a reverse lockout to prevent the marine propulsion system from pivoting through hinge action of the motor mount 2901 in relate to the transom mount 2903 when the marine propulsion system is placed in a reverse gear. The release pin locks the breakaway feature allowing the motor to pull the boat backward without lifting up/away from the operator. Aside from reverse operation, the release pin should always be out, except perhaps to reduce bounce in the mechanism when trailering, if desired. Again, mounting bolts can be seen through the transom mount 2903 for attachment of the breakaway jack plate 2900 to the transom of a boat.

Figure 32:
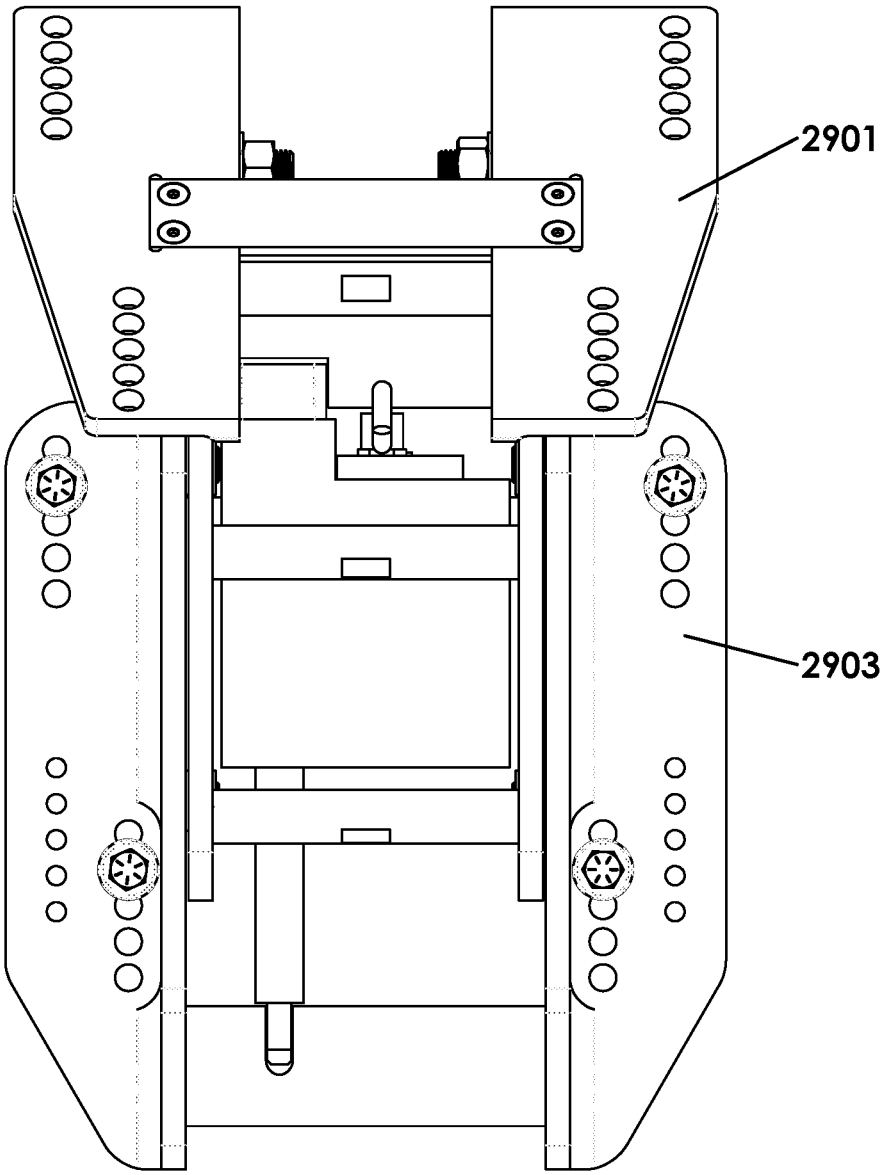
FIG. 32 is a plan view of the breakaway jack plate of FIG. 29 in a motor raised position.

FIG. 32 is a plan view of the breakaway jack plate 2900 in a motor raised position where the motor mount 2901 is raised in relation to the transom mount 2903.

Figure 33:
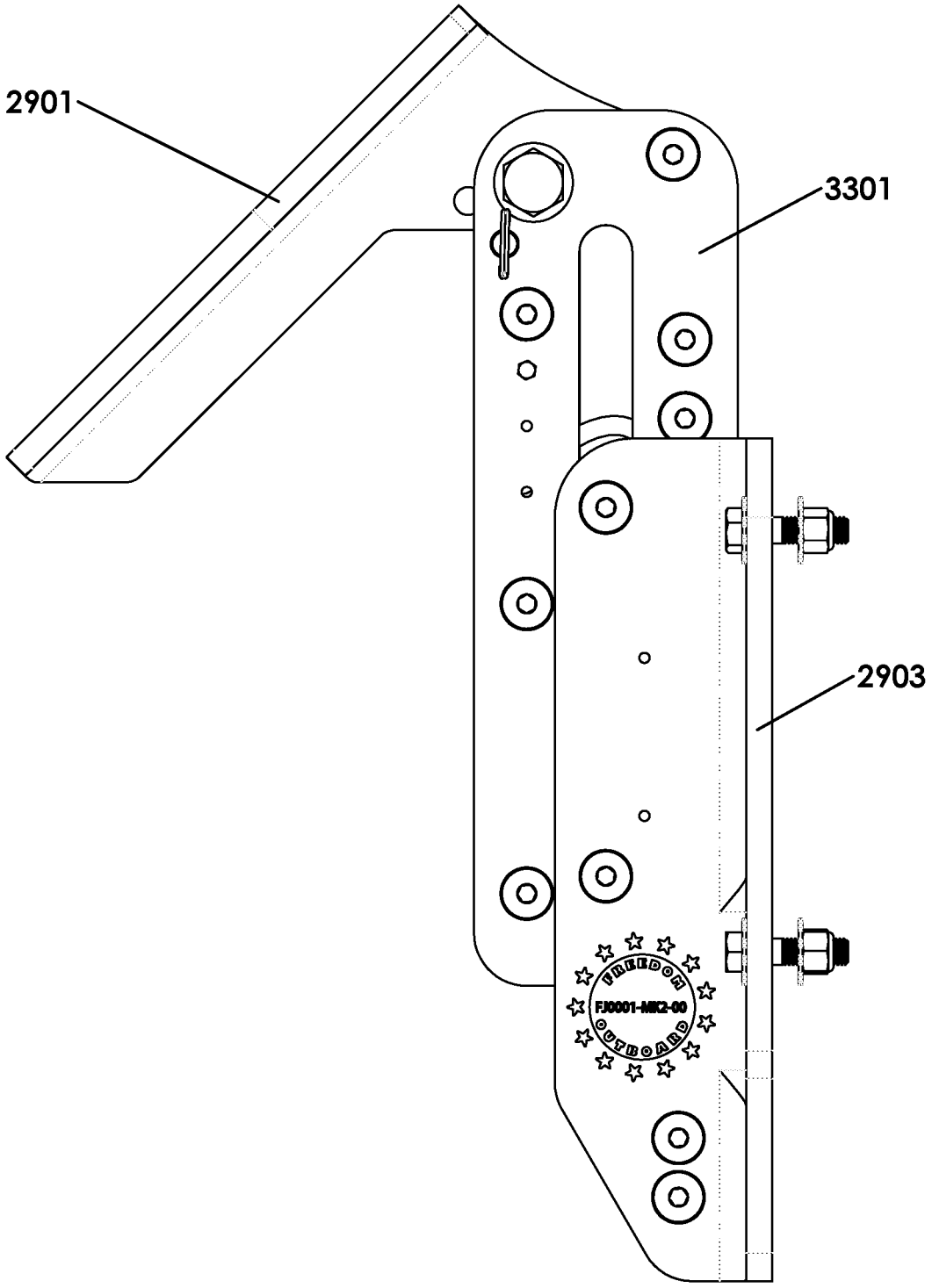
FIG. 33 is a side view of the breakaway jack plate of FIG. 29 in a motor raised position.

FIG. 33 is a side view of the breakaway jack plate 2900 in a motor raised position. In this view the cam plate 3301 can be seen where the cam plate is hingeably connected to the motor mount 2901. The cam plate 3301 is also connected to the transom mount 2903 by way of a slot in the cam plate 3301 that receives a bolt protruding from the transom mount 2903, thus allowing the cam plate 3301 and attached motor mount 2901 to move vertically in relation to the transom mount 2903. The slot allows for the cam plate 3301 to be slideably engaged with the transom mount 2903, allowing for vertical displacement of the marine propulsion system of the present invention. In some embodiments, an electric actuator or hydraulic system may be employed to change the position of the breakaway jack plate 2900.

Figure 34:
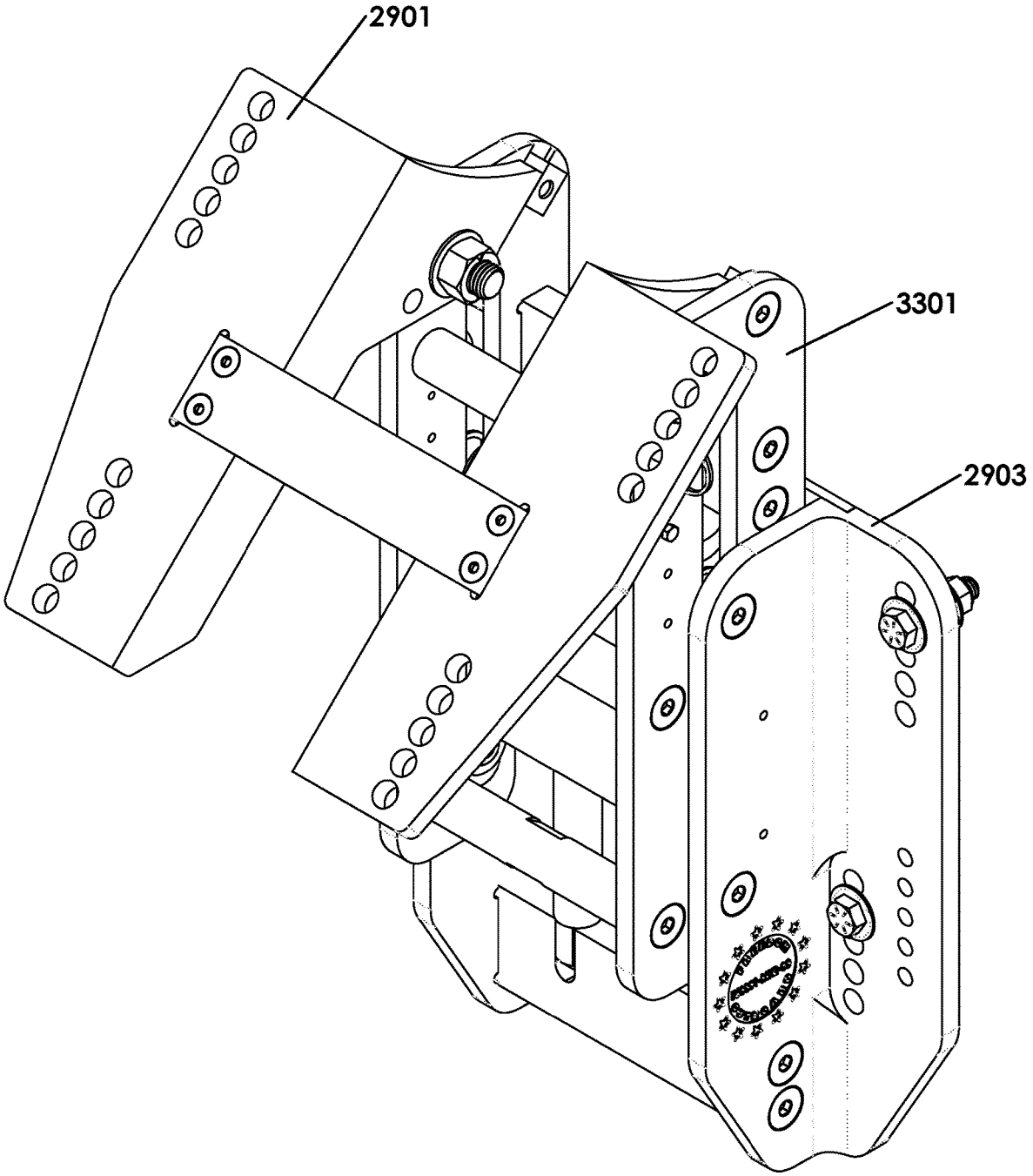
FIG. 34 is a perspective view of the breakaway jack plate of FIG. 29 in a motor raised position.

FIG. 34 is a perspective view of the breakaway jack plate 2900 in a motor raised position. In this view, the relation between the transom mount 2903, the cam plate 3301 and the motor mount 2901 can be seen. The breakaway jack plate thus allows an attached marine propulsion system to be rotated upward at an angle in relation to the transom of the boat as well as allowing the marine propulsion system to be raised vertically in relation to the transom of the boat.

FIG. 35 is a functional block diagram of the cooling system of the present invention.

While the marine propulsion system of the present invention has been described by way of an outboard motor that is propeller driven, other forms of marine propulsion systems exist and many, if not all, can benefit from various embodiments of the present invention as described and envisioned herein.

The starboard heat exchanger and the port side heat exchanger connect with the overall cooling system of an outboard marine propulsion system, as previously described. As most outboard motors have open loop cooling systems where marine environment water is fed directly into the outboard motor for cooling purposes, the cooling system of the present invention will also be described by way of the diagram depicted in FIG. 35, which is a functional block diagram of the cooling system of the present invention. Flow directions are indicated by arrow heads.

Following through the diagram in FIG. 35, the starboard heat exchanger and the port side heat exchanger (two elements 3501) are in fluid communication with the coolant loop where coolant flows from the two elements through an expansion tank 3503. The coolant loop is driven by a pump 3505 that may be driven from the marine motor such as by way of a mechanical coupling to the cam of the marine motor. The pump 3505 may be driven by an electric motor in some embodiments of the present invention. Coolant then exits the pump 3505 and enters the motor 3507 and the cylinder head 3511 where cooling passageways are located in order to reduce the operating temperature of the marine motor during operation. A fuel chiller 3509 may be present in a line between the motor 3507 and the expansion tank 3503. A thermostat 3513 is employed to ensure that coolant enters the marine motor only when the marine motor reaches a pre-defined temperature to allow for efficient start up operation. The coolant then exits the motor in 3515 and returns to the two elements 3501 (the starboard side heat exchanger and the port side heat exchanger) where heat is transferred from the coolant through the heat exchanger and into the marine operating environment, thus completing the cooling loop.

Figure 36:
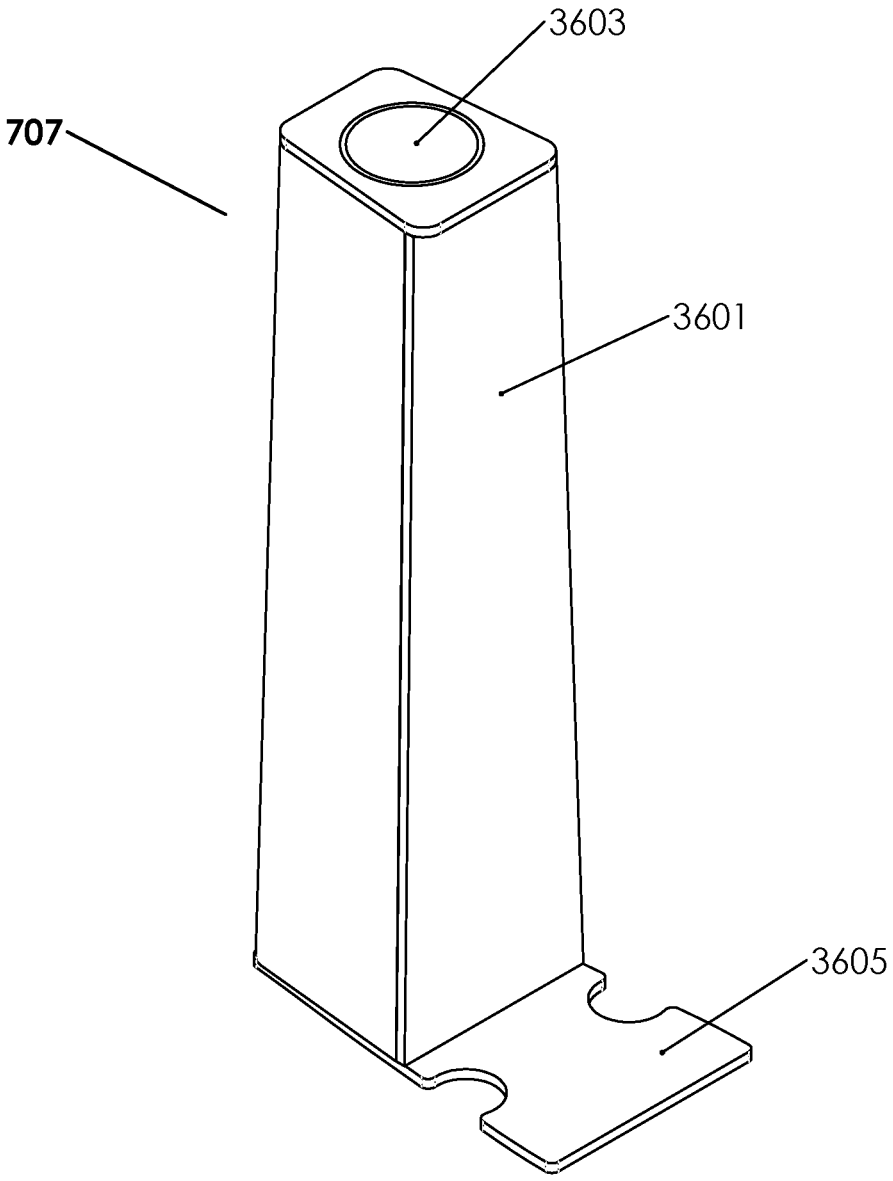
FIG. 36 is a perspective view of an exhaust shroud of the present invention.

FIG. 36 is a perspective view of the exhaust shroud 707 as previously described and depicted in FIG. 7. The exhaust shroud 707 is made from a suitable metal such as stainless steel, brass, aluminum, or the like. The exhaust shroud 707 sits in the wet exhaust cavity of the marine propulsion system, as depicted in FIG. 7. Since the marine propulsion system does not expel water as it would in an open loop cooling arrangement, the exhaust is no longer cooled. This lack of cooling can cause the mid-section of the marine propulsion system to heat up to high temperatures that can discolor the marine propulsion system and possibly cause injury to the operator. The exhaust shroud 707 provides an air pocket that creates a thermal barrier and thus a layer of protection between the exhaust and the body of the marine propulsion system. The exhaust is now channeled through a tube that runs the length of the exhaust shroud 707, thus protecting the motor from excess heat by way of the pocket of air that surrounds the tube. The exhaust shroud 707 comprises an exhaust shroud housing 3601, an exhaust shroud port 3603 and an exhaust shroud mounting foot 3605. The exhaust shroud 707 fits the void of the exhaust cavity of the motor and aligns to the exhaust foot in the lower unit when assembled. The exhaust shroud housing 3601 may, in some embodiments, be rectangular and have an exhaust shroud port 3603 therethrough. The exhaust shroud port 3603 may, in some embodiments, be cylindrical. An air space exists between the exhaust shroud port 3603 and the exhaust shroud housing 3601. The exhaust shroud port 3603 is a tube that runs the length of the exhaust shroud housing 3601 and carries the exhaust of the motor while the overall exhaust shroud 707 prevents the heat from the exhaust from damaging the marine propulsion system. The exhaust shroud mounting foot 3605 is welded or otherwise attached to the bottom of the exhaust shroud housing 3601 and may contain cutouts for retention of the exhaust shroud 707 by way of bolts or similar fasteners.

Figure 37:
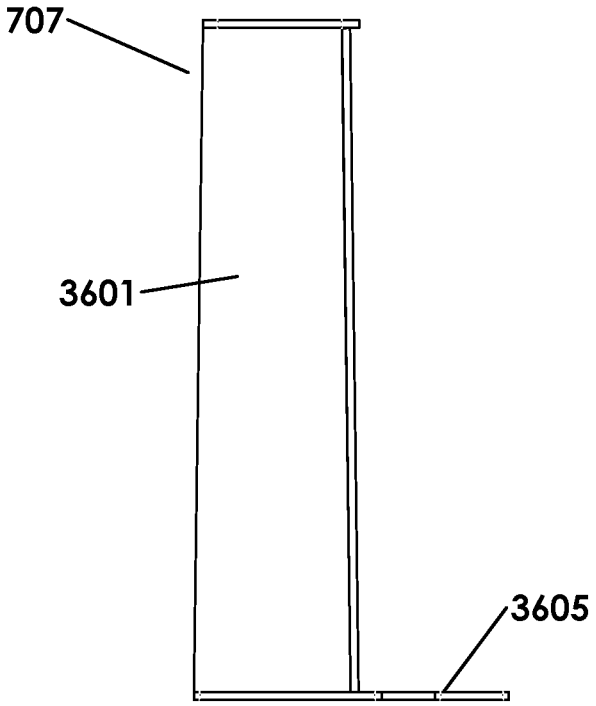
FIG. 37 is side view of the exhaust shroud of FIG. 36.

FIG. 37 is side view of the exhaust shroud 707 showing the exhaust shroud housing 3601 and the exhaust shroud mounting foot 3605 attached to the bottom of the exhaust shroud 707.

Figure 38:
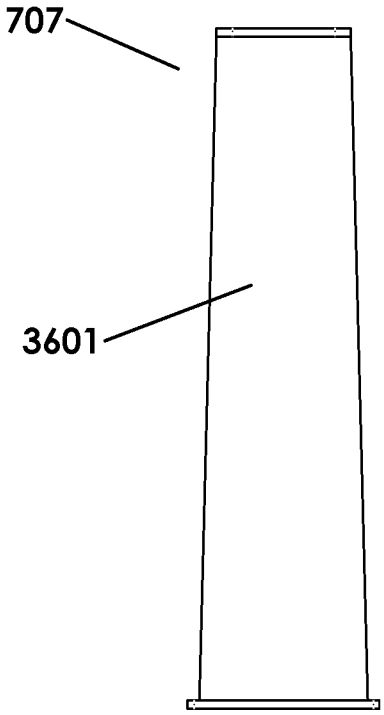
FIG. 38 is an alternate side view of the exhaust shroud of FIG. 36.

FIG. 38 is an alternate side view of the exhaust shroud 707.

Figure 39:
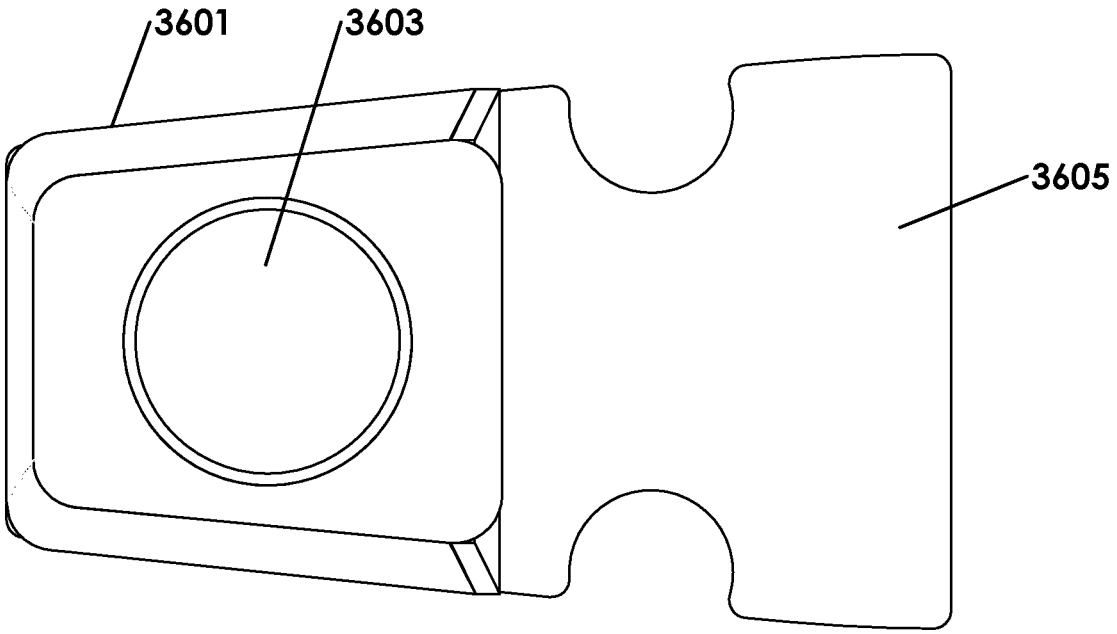
FIG. 39 is a top plan view of the exhaust shroud of FIG. 36.

FIG. 39 is a top plan view of the exhaust shroud 707 showing the exhaust shroud port 3603 colinear with the exhaust shroud housing 3601. The exhaust shroud mounting foot 3605 can also be seen.

Figure 40:
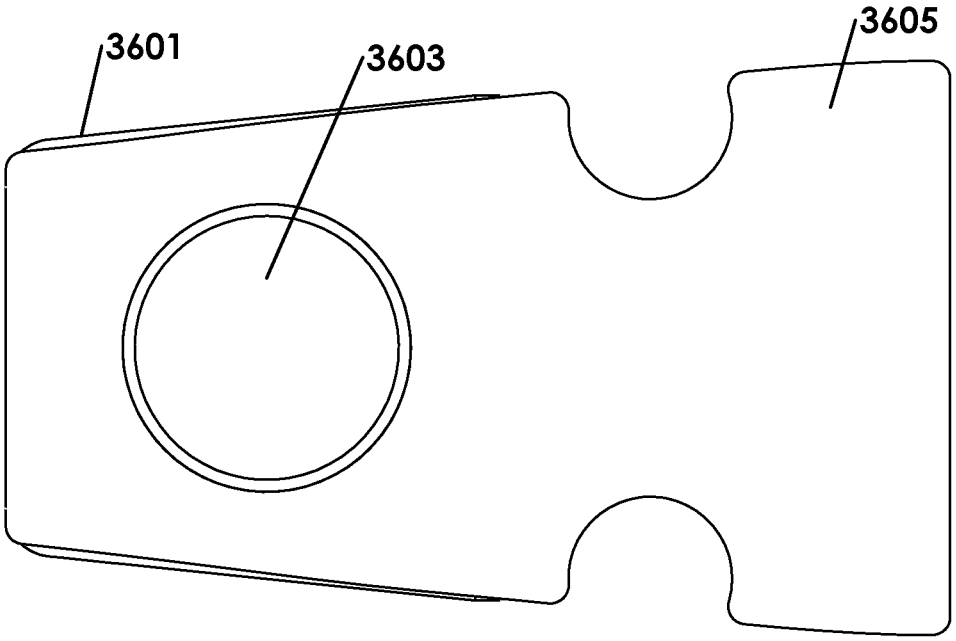
FIG. 40 is a bottom plan view of the exhaust shroud of FIG. 36.

FIG. 40 is a bottom plan view of the exhaust shroud 707 showing the exhaust shroud port 3603 where the exhaust shroud port 3603 runs from the top to the bottom of the exhaust shroud housing 3601.

Figure 41:
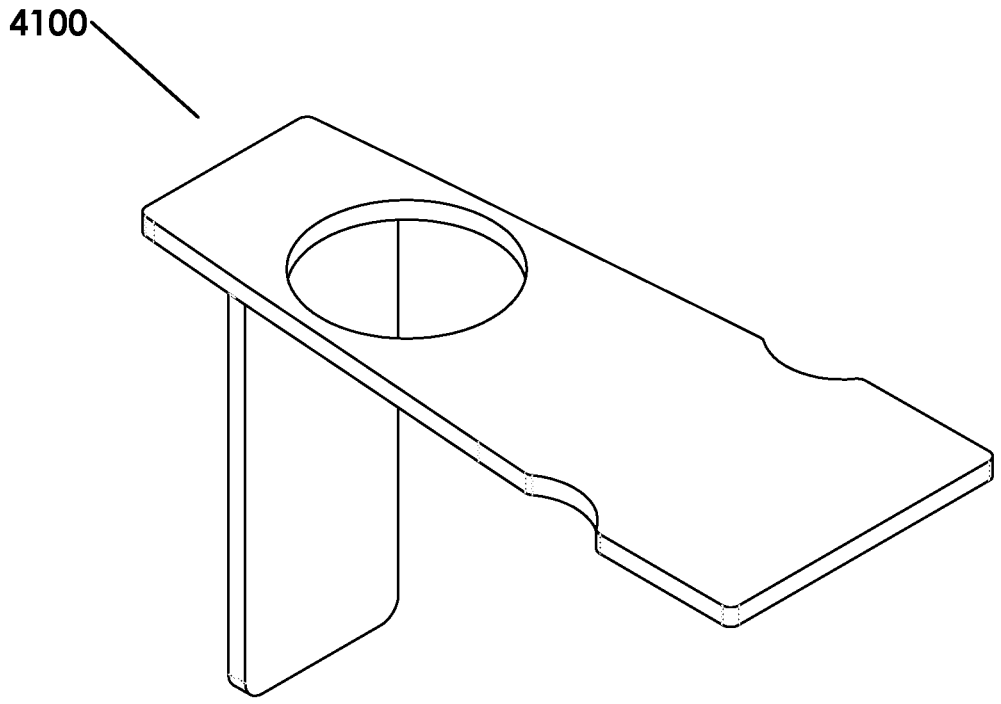
FIG. 41 is a perspective view of an exhaust shroud mounting plate.

To facilitate attachment of the exhaust shroud 707, an exhaust shroud foot 4100 is employed where a circular opening for the exhaust port 3603 can be seen along with two recesses and a rectangular plate which is attached in a perpendicular manner. FIG. 41 is a perspective view of the exhaust shroud foot 4100.

Figure 42:
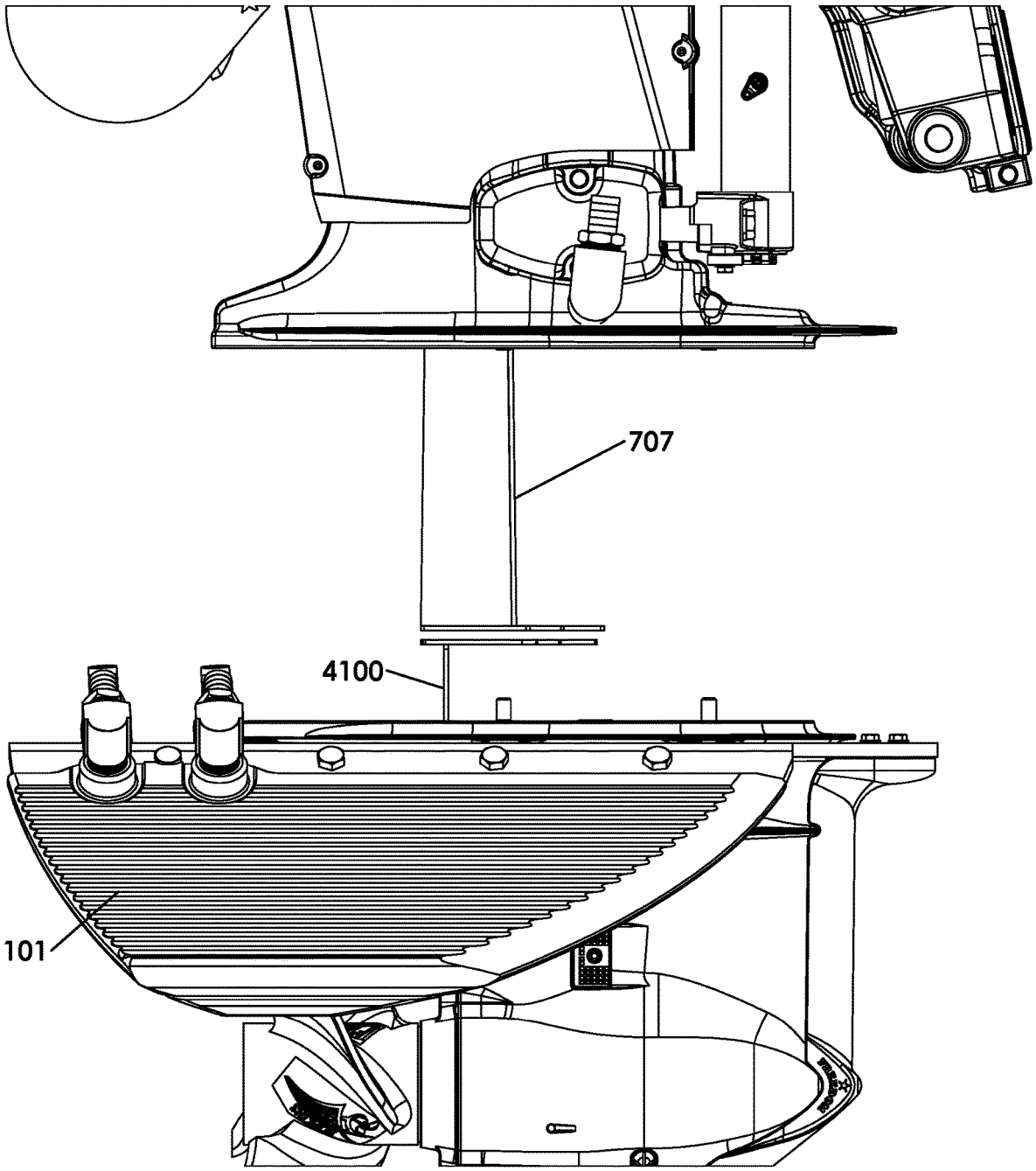
FIG. 42 is an exploded view of the lower unit of the present invention showing the placement of the exhaust shroud.

Lastly, FIG. 42 is an exploded view of the lower unit of the present invention showing the placement of the exhaust shroud 707.

It is, therefore, apparent that there has been provided, in accordance with the various objects of the present invention, a marine propulsion system with a closed coolant loop.

While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims, and drawings appended herein.

What is claimed is:

1. A marine propulsion system with a closed coolant loop, the marine propulsion system comprising:

an outboard motor comprising a power head and a submerged drive unit;

coolant passageways within the power head of the outboard motor;

a starboard heat exchanger and a port side heat exchanger each having a leading edge and a trailing edge, wherein both the starboard heat exchanger and the port side heat exchanger are each discretely mounted on the submerged drive unit of the outboard motor and in closed fluid communication with the coolant passageways within the power head of the outboard motor;

a coolant reservoir mechanically attached to the marine propulsion system; and a water pump configured to circulate coolant between the coolant reservoir, the starboard heat exchanger and the port side heat exchanger, and the coolant passageways within the power head of the outboard motor.

2. The marine propulsion system with closed coolant loop of claim 1, wherein the starboard heat exchanger and the port side heat exchanger are symmetrical to each other.

3. The marine propulsion system with a closed coolant loop of claim 1, wherein the starboard heat exchanger and the port side heat exchanger are discrete foil units.

4. The marine propulsion system with a closed coolant loop of claim 1, further comprising an exhaust shroud within an exhaust cavity of the marine propulsion system where the exhaust shroud comprises an exhaust shroud housing and an exhaust shroud port within the exhaust shroud housing.

5. The marine propulsion system with a closed coolant loop of claim 1, further comprising a bumper that covers a leading edge of the submerged drive unit.

6. The marine propulsion system with a closed coolant loop of claim 5, wherein the bumper comprises a skeg cradle, a skeg leading edge cover, a gear housing cover, a leading edge cover, and a heat exchanger bracket mount.

7. The marine propulsion system with a closed coolant loop of claim 1, further comprising a break away jack plate.

8. The marine propulsion system with a closed coolant loop of claim 7, wherein the break away jack plate comprises a motor mount, a transom mount and a cam plate.

9. The marine propulsion system with a closed coolant loop of claim 1, further comprising a weedless propeller engaged with the submerged drive unit.

10. The marine propulsion system with a closed coolant loop of claim 1, wherein the leading edge of the starboard heat exchanger and the leading edge of the port side heat exchanger are formed as an arc.

11. The marine propulsion system with a closed coolant loop of claim 1, wherein the starboard heat exchanger and the port side heat exchanger are mounted on the submerged drive unit of the outboard motor with a downward angle such that the angle between each heat exchanger and the submerged drive unit is less than 90 degrees.

12. The marine propulsion system with a closed coolant loop of claim 1, wherein the starboard heat exchanger and the port side heat exchanger comprise serpentine passageways for the flow of coolant.

13. The marine propulsion system with a closed coolant loop of claim 1, wherein the starboard heat exchanger and the port side heat exchanger comprise cooling ridges.

14. The marine propulsion system with a closed coolant loop of claim 1, further comprising a surface drive extension, the surface drive extension comprising:

an elongated drive tunnel;

a skeg having an upper section and a lower section where the upper section is joined with the elongated drive tunnel;

a skeg foil attached to the lower section of the skeg;

a mounting fin attached to the elongated drive tunnel; and a driveline within the elongated drive tunnel wherein the driveline comprises a drive shaft of the marine propulsion system with a closed coolant loop and an extension shaft configured to receive a marine propeller.

15. The marine propulsion system with a closed coolant loop of claim 14, further comprising a propeller hub coupled to the extension shaft of the surface drive extension.

16. The marine propulsion system with a closed coolant loop of claim 14, further comprising a universal joint coupled to the extension shaft of the surface drive extension.

17. A marine propulsion system with a closed coolant loop, the marine propulsion system comprising:

an outboard motor comprising a power head and a submerged drive unit, wherein the submerged drive unit comprises a propeller hub;

coolant passageways within the power head of the outboard motor;

a starboard heat exchanger and a port side heat exchanger each having a leading edge and a trailing edge, wherein both the starboard heat exchanger and the port side heat exchanger are each discretely mounted on the submerged drive unit of the outboard motor and in closed fluid communication with the coolant passageways within the power head of the outboard motor;

a coolant reservoir mechanically attached to the marine propulsion system;

a water pump configured to circulate coolant between the coolant reservoir, the starboard heat exchanger and the port side heat exchanger, and the coolant passageways within the power head of the outboard motor; and a surface drive extension comprising an elongated drive tunnel, a skeg having an upper section and a lower section where the upper section is joined with the elongated drive tunnel, a skeg foil attached to the lower section of the skeg, a mounting fin attached to the elongated drive tunnel, and a driveline within the elongated drive tunnel wherein the driveline comprises a drive shaft coupling configured to receive a drive shaft from a marine propulsion system and an extension shaft configured to receive a marine propeller;

wherein the drive shaft coupling of the surface drive extension is mechanically coupled to the propeller hub of the submerged drive unit and the surface drive extension is structurally coupled to the submerged drive unit.

18. The marine propulsion system with a closed coolant loop of claim 17, further comprising a break away jack plate.

19. The marine propulsion system with a closed coolant loop of claim 17, further comprising an exhaust shroud within an exhaust cavity of the marine propulsion system where the exhaust shroud comprises an exhaust shroud housing and an exhaust shroud port within the exhaust shroud housing.

20. The marine propulsion system with a closed coolant loop of claim 17, wherein the starboard heat exchanger and the port side heat exchanger are discrete foil units.

* * * * *